US006706670B2

(12) United States Patent
Kalota et al.

(10) Patent No.: US 6,706,670 B2
(45) Date of Patent: Mar. 16, 2004

(54) WATER SOLUBLE METAL WORKING FLUIDS

(75) Inventors: Dennis J. Kalota, Fenton, MO (US); Yueting Chou, Chesterfield, MO (US); Timothy K. Hirzel, St. Louis, MO (US); David C. Silverman, Chesterfield, MO (US); Jacob S. Tou, Ballwin, MO (US); Winsor R. Cho, Glencoe, MO (US)

(73) Assignee: Solutia, Inc., St. Louis, MO (US)

( * ) Notice: Subject to any disclaimer, the term of this patent is extended or adjusted under 35 U.S.C. 154(b) by 119 days.

(21) Appl. No.: 09/242,821

(22) PCT Filed: Aug. 29, 1997

(86) PCT No.: PCT/US97/15241

§ 371 (c)(1),
(2), (4) Date: Feb. 24, 1999

(87) PCT Pub. No.: WO98/08919

PCT Pub. Date: Mar. 5, 1998

(65) Prior Publication Data

US 2003/0162671 A1 Aug. 28, 2003

Related U.S. Application Data

(60) Provisional application No. 60/024,976, filed on Aug. 30, 1996.

(51) Int. Cl.[7] ..... C10M 141/02; C10M 173/00

(52) U.S. Cl. ..... 508/185; 72/42; 508/269; 508/434; 508/438; 508/437; 508/440; 508/442; 508/508; 508/509; 508/510; 508/511; 508/516; 508/539

(58) Field of Search ..... 508/185, 269, 508/437, 438, 440, 442, 508–511, 516, 539, 434; 70/42

(56) References Cited

U.S. PATENT DOCUMENTS 2,231,228 A 2/1941 Singer ..... 252/33

(List continued on next page.)

FOREIGN PATENT DOCUMENTS

DE 3421 475 A1 12/1984 ..... C10M/3/26

(List continued on next page.)

OTHER PUBLICATIONS

Database WPI Section Ch, Week 9537; Derwent Publications Ltd., London, GB; AN 95–281186 XP002065706; & JP 07 179 876 A (Idemitsu Kosan Co Ltd).

(List continued on next page.)

*Primary Examiner*—Jacqueline V. Howard
(74) *Attorney, Agent, or Firm*—Janelle D. Strode; Lathrop & Gage

(57) ABSTRACT

This invention relates to novel water soluble metal working fluid compositions, their use to work metal, a process for working metal using such compositions and the metal worked article of manufacture. More particularly, this invention relates to fluid compositions useful in cutting, grinding, shaping and other metal working operations which require a lubricant. The terms "first Group A" and "second Group B" are used herein to denote different groups and not to indicate any sequence of use or selection as any possible combination or sequence of use of a component(s) is envisioned without limit of any kind. The disclosed fluid compositions are also anticorrosive and environmentally more acceptable than current oil based fluids. There has now been discovered an essentially odorless, substantially non-oil misting, water-soluble metal working fluid comprising at least one component selected from a first Group A herein and optionally one or more components selected from a second Group B herein preferably with the balance of the composition being water and other (optional) minor ingredients. When a component is employed from Group A and a component is employed from Group B the action of the combination generally enhances performance of the resulting combination with contain moieties from both Group A and Group B.

49 Claims, 18 Drawing Sheets

U.S. PATENT DOCUMENTS

| | | | | | |
|---|---|---|---|---|---|
| 3,051,655 | A | | 8/1962 | Parker | 252/49.9 |
| 3,079,340 | A | | 2/1963 | Reamer | 252/33.6 |
| 3,375,193 | A | | 3/1968 | Ruzza et al. | 252/23 |
| 3,425,940 | A | | 2/1969 | Norton | 252/8.5 |
| 3,527,726 | A | | 9/1970 | Gower et al. | 260/29.6 |
| 3,645,897 | A | | 2/1972 | Gower et al. | 252/34.7 |
| 3,723,313 | A | | 3/1973 | Churn | 252/33.3 |
| 3,787,227 | A | | 1/1974 | Marans | 117/75 |
| 3,788,988 | A | | 1/1974 | Dubourg | 252/32.5 |
| 3,846,449 | A | | 11/1974 | Magne et al. | 260/327 |
| 3,926,822 | A | * | 12/1975 | Habiby | 72/42 |
| 3,933,658 | A | | 1/1976 | Beiswanger et al. | 252/31 |
| 3,933,660 | A | | 1/1976 | Tadenuma et al. | 252/32.5 |
| 3,945,931 | A | | 3/1976 | Bussi et al. | 252/32.5 |
| 3,966,619 | A | | 6/1976 | Smith et al. | 252/32.5 |
| 4,138,346 | A | | 2/1979 | Nassry et al. | 252/32.5 |
| 4,144,188 | A | | 3/1979 | Sato | 252/389 R |
| 4,177,154 | A | | 12/1979 | Chakrabarti | 252/32.5 |
| 4,199,381 | A | | 4/1980 | Nuss et al. | 148/6.15 R |
| 4,215,002 | A | | 7/1980 | Fein | 252/32.5 |
| 4,260,499 | A | | 4/1981 | Fein et al. | 252/32.5 |
| 4,289,546 | A | | 9/1981 | Hacias | 148/6.15 |
| 4,289,547 | A | | 9/1981 | King et al. | 148/6.15 R |
| 4,313,836 | A | | 2/1982 | Nassry et al. | 252/32.7 E |
| 4,342,658 | A | | 8/1982 | Tincher et al. | 252/32.5 |
| 4,366,076 | A | | 12/1982 | Clark | 252/34 |
| 4,377,487 | A | | 3/1983 | Freeman | 252/33.4 |
| 4,384,965 | A | | 5/1983 | Hellsten et al. | 252/32.5 |
| 4,419,253 | A | | 12/1983 | Kennedy et al. | 252/34.7 |
| 4,425,248 | A | | 1/1984 | Piotrowski et al. | 252/49.3 |
| 4,559,153 | A | * | 12/1985 | Baldwin et al. | 72/42 |
| 4,612,127 | A | * | 9/1986 | Uematsu et al. | 72/42 |
| 4,615,813 | A | | 10/1986 | Bretz | 252/8.514 |
| 4,626,367 | A | | 12/1986 | Kuwamoto et al. | 252/49.5 |
| 4,633,321 | A | | 12/1986 | Tallant, II | 358/243 |
| 4,650,595 | A | | 3/1987 | Nagamori et al. | 252/32.5 |
| 4,654,155 | A | | 3/1987 | Kipp et al. | 252/32.5 |
| 4,663,061 | A | | 5/1987 | Kuwamoto et al. | 252/32.5 |
| 4,702,854 | A | | 10/1987 | Snyder et al. | 252/75 |
| 4,722,767 | A | | 2/1988 | Schuettenberg et al. | 252/48.2 |
| 4,758,359 | A | | 7/1988 | Kirk et al. | 252/32.5 |
| 4,859,351 | A | | 8/1989 | Awad | 252/32.5 |
| 4,880,552 | A | | 11/1989 | Guesnet et al. | 252/34 |
| 4,883,606 | A | | 11/1989 | Kuwamoto et al. | 252/32.5 |
| 4,923,625 | A | | 5/1990 | King | 252/32.5 |
| 4,927,550 | A | * | 5/1990 | Cutcher et al. | 72/42 |
| 4,938,891 | A | | 7/1990 | Lenack et al. | 252/49.3 |
| 4,950,415 | A | * | 8/1990 | Malito | 72/42 |
| 5,132,046 | A | | 7/1992 | Edebo et al. | 252/49.3 |
| 5,348,670 | A | | 9/1994 | McDonald et al. | 252/32.5 |
| 5,399,274 | A | | 3/1995 | Marcus | 252/49.3 |
| 5,401,428 | A | | 3/1995 | Kalota et al. | 252/49.3 |
| 5,584,945 | A | * | 12/1996 | Nittel et al. | 72/42 |
| 5,616,544 | A | * | 4/1997 | Kalota et al. | 72/42 |

FOREIGN PATENT DOCUMENTS

| | | | |
|---|---|---|---|
| DE | 195 32 208 A1 | 3/1997 | 105/74 |
| EP | 0 041 927 | 12/1981 | C23F/11/12 |
| EP | 0 043 182 | 1/1982 | |
| EP | 0 052 751 | 6/1982 | 3/4 |
| EP | 0 260 019 | 3/1988 | 173/2 |
| EP | 0 291 102 | 7/1988 | 173/2 |
| EP | 0 297 046 | 12/1988 | 173/2 |
| EP | 0 389 967 | 10/1990 | 137/2 |
| EP | 0 435 444 A1 | 7/1991 | 129/40 |
| EP | 0 586 711 A1 | 3/1994 | C23C/26/00 |
| GB | 735711 | 8/1955 | |
| GB | 1319 121 | 6/1973 | C10M/3/40 |
| GB | 1 500 718 | 2/1978 | 3/14 |
| GB | 1539163 | 1/1979 | 3/30 |
| GB | 2 058 145 A | 4/1981 | C23F/7/10 |
| GB | 2 142 650 A | 1/1985 | C10M/3/26 |
| WO | WO 87/07638 | 12/1987 | 141/10 |
| WO | WO 97/04052 | 2/1997 | 173/2 |

OTHER PUBLICATIONS

Database WPI Section Ch, Week 9312; Derwent Publications Ltd., London, GB; AN 93–096935 XP002065707 & JP 05 039 493 A (Sintobrator KK).

Database WPI Section Ch, Week 8718; Derwent Publications Ltd., London, GB; AN 87–127164 XP002065708 & JP 62 070 493 A (Yushiro Kagaku Kogyo KK).

Database WPI Section Ch, Week 9248; Derwent Publications Ltd., London, GB; AN 92–395751 XP002065709 & JP 04 296 395 A (Neos KK).

Database WPI Section Ch, Week 9118; Derwent Publications Ltd., London, GB; AN 91–128578 XP002049810 & JP 03 066 798 A (Neos KK), Mar. 22, 1991.

Database WPI Section Ch, Week 7930; Derwent Publications Ltd., London, GB; AN 79–55351B XP002049883 & JP 54 074 969 A (Nippon Paint Co Ltd), Jun. 15, 1979.

Database WPI Section Ch, Week 9023; Derwent Publications Ltd., London, GB; AN 90–174295 XP002049884 & JP 02 113 082A (Kagaku Kogyo KK), Apr. 25, 1990.

* cited by examiner

WATER SOLUBLE METAL WORKING FLUIDS

This application is a 371 of PCT/US97/15241 Aug. 29, 1997 This application also claims the benefit of provisional application No. 60/024,976 filed Aug. 30, 1996.

BACKGROUND OF THE INVENTION

Metal working of a metal using a tool to work the metal is a practice which has been carried out for years. Prior art fluids have been used to facilitate such metal working. However, previously known oil-containing metal working fluids require reclaiming or disposal other than by discharging to common sewage treatment systems. In some cases the cost of disposal has become such a major cost that it approaches the initial cost of the fluid.

Without being bound by theory it is believed that metal working fluids fulfill one or more functions in various metal working applications. Typically, such illustrative nonlimiting functions include removal of heat from the work piece and tool (cooling), reduction of friction among chips, tool and work piece (lubrication), removal of metal debris produced by the work, reduction or inhibition of corrosion and prevention or reduction of build-up on edges as between the work piece and the tool. Thus these one or more functions usually require a formulation or combination of components in the lubricant fluid to accomplish the best attributes required for a particular metal working operation.

References for metal working disclaim an illustrative variety of metal working operations include The $12^{th}$ American Machinist Inventory of Metalworking Equipment 1976–78, American Machinist, December 1978 and November 1983; McGraw-Hill, Inc. 1221 Avenue of the Americas, New York N.Y. 10020;

Lubricants, Cutting Fluids, and Coolants; Wilbert J. Olds, Cahners Books, 89 Franklin Street, Boston, Mass. 02110;

TRIBOLOGY IN METAL WORKING, Friction, Lubricant and Wear, John A. Schey, Professor , Department of Mechanical Enginering, University of Waterloo, Ontario, Canada, American Society for Metals, Metals Park, Ohio 44073. All three above references are incorporated herein in their entirety by reference.

Various fluids at times have been recently proposed to be substituted for oil-containing metal working fluids such as primary amides, ethylenediamine tetraacetic acid, fatty acid esters, and alkanolamine salts. Such compounds can be replenished during use by dissolving tablets containing such compounds during the useful life of the fluid. See U.S. Pat. No. 4,144,188 to Sato.

Some amines have also been found useful in cutting oils as antibacterial agents. Such amines include alkanolamine and arylalkylamine such as p-benzylaminophenol. See EPO 90-400732 to Noda et al.

As noted above, one of the problems occurring in industry is the proper disposal of metal working fluids. The above mentioned amines are removed from the fluids by biodegradation, requiring facilities such as settling tanks, treatment tanks and sludge treatment tanks. Such a system is disclosed in Japanese Patent 03181395. Other methods of waste disposal and oil removal systems are employed to comply with environmental standards.

Worker safety can be an issue with presently employed oil-containing water soluble metal working fluids. Such fluids unavoidably come in contact with workers using the fluids in cutting, bending, threading and other metal working applications. Such oil-containing fluids may create a mist at the site of the work piece being operated on or when the fluid is sprayed and such mist travels through the air in the vicinity of the machine and the operator thereof. Some attempts have been made to reduce the mist problem as is noted in British Patent 2,252,103. There is disclosed therein a polymeric thickener comprising a copolymer of acrylamide, sodium acrylate and N-n-octyl acrylamide. The copolymer is formulated with water soluble and water insoluble monomer.

Because of the misting and drift thereof in the work place employing some commonly employed water-soluble metal working fluids, there is usually associated with such work place a distinctive odor which permeates the entire area. Usually such odor is unpleasant and is tolerated as a condition which is unavoidable.

There is needed an odorless, non-oil misting, water soluble metal working fluid, particularly useful in cutting operations. There is also needed a fluid which would dispense with the need for disposal costs, and provide the work place with a more sanitary and acceptable atmosphere in which to work.

OBJECT(S) OF THE INVENTION

It is an object of the invention to provide an enhanced lubricating composition for use in metal working environments.

It is another object of the invention to provide an enhanced lubricating composition which is effective with and without use of a phosphate or phosphonate or borates.

It is a further object of the invention to provide an enhanced lubricating composition which is effective with the use of phosphorus containing compounds.

It is yet another object of the invention to provide an enhanced lubricating composition useful in extreme pressure applications.

It is yet a further object of the invention to provide an enhanced lubricating composition containing a lubricating imparting component which contains a carboxylate moiety and a phosphorus moiety within the same molecule.

It is yet a further object of the invention to provide an enhanced lubricating composition which is effective when used with borate compounds.

It is yet a further object of the invention to provide an enhanced lubricating composition containing a lubricating imparting mixture in which one component contains an amide and the same or a second component contains a phosphorus moiety.

Yet another further object of this invention is to provide an enhanced lubricating composition containing manufactured and naturally occurring polymers such as proteins used with or without a phosphorus moiety or borate moiety to provide the extreme pressure lubrication and additionally simple or boundary lubrication.

These and other objects are met in the invention herein, a nonlimiting description of which follows hereinafter.

BRIEF DESCRIPTION OF THE INVENTION

There has now been discovered an essentially odorless, substantially non-oil misting, water soluble metal working fluid useful for a variety of metal working operations, including without limitation cutting, grinding, forming, and the like comprising at least one component selected from a first Group A herein and optionally one or more components selected from a second Group B herein—preferably with the balance of the composition being water and other (optional) minor ingredients. When a component is employed from Group A and a component is employed from Group B the action of the combination generally enhances performance of the resulting combination. If desired optionally more than one component can be utilized from Group A and/or Group B depending on the specific application or in addition if desired a component from Group A can be an adduct of components from Group A and Group B whereby that resulting adduct component importing enhanced lubrication contains a carboxylate and phosphorus moiety within the same molecule.

The invention comprises a method of metal working which comprises providing as a lubricant to said metal, a lubricating effective amount of a fluid lubricant composition comprising one or more water soluble components selected from: a first group (A) comprising:

amides; polyamides; polyamino acids, salts and esters; a monocarboxylic acid(s) having one to six carbon atoms functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; polycarboxylic acids, salts or their esters; amino acids, salts and esters; sulfonic acids and salts; a sulfur compound selected from mercaptan, sulfide, disulfide or polysulfide; mercaptocarboxylic acids, salts and esters; keto acids; amine substituted organo acids; substituted amino acids, salts and esters; organosulfonates; sodium or potassium sulfide, sodium or potassium hydrogen sulfide, organic acids containing one or more moieties selected from carboxylate, sulfate, sulfonate, phosphate, or phosphonate, present as the free acids, or their salts; organic acids containing one or more moieties selected from carboxylate, sulfate, sulfonate, phosphate, or phosphonate present as the free acids or their salts, and additionally a moiety selected from sulfone, sulfonamide, sulfonic ester, sulfate ester, ketone, carboxylic ester, amide, amine, ether, sulfide, disulfide, or aryl; alone or optionally with one or more components selected from a second Group (B) comprising:

phosphates, borates, phosphonates, phosphites and hypophosphites; and which composition provides a synergistic lubricating or added functionality effect when used with one or more component(s) of Group (A) and Group (B).

In one embodiment, the composition comprises a reaction product(s) of said composition associated with a component or components therein or the application of said composition to a metal being worked. The lubricants employed herein have a lubricant property selected from the group consisting of extreme pressure, boundary lubricant, simple film or anti-wear or combinations thereof. It is most preferred to employ a phosphate as a component of Group B of this invention along with polyamino acid or polycarboxylate or amide or polyamide or amino acid as a component of Group A.

DETAILED DESCRIPTION OF THE INVENTION

Figure 1:
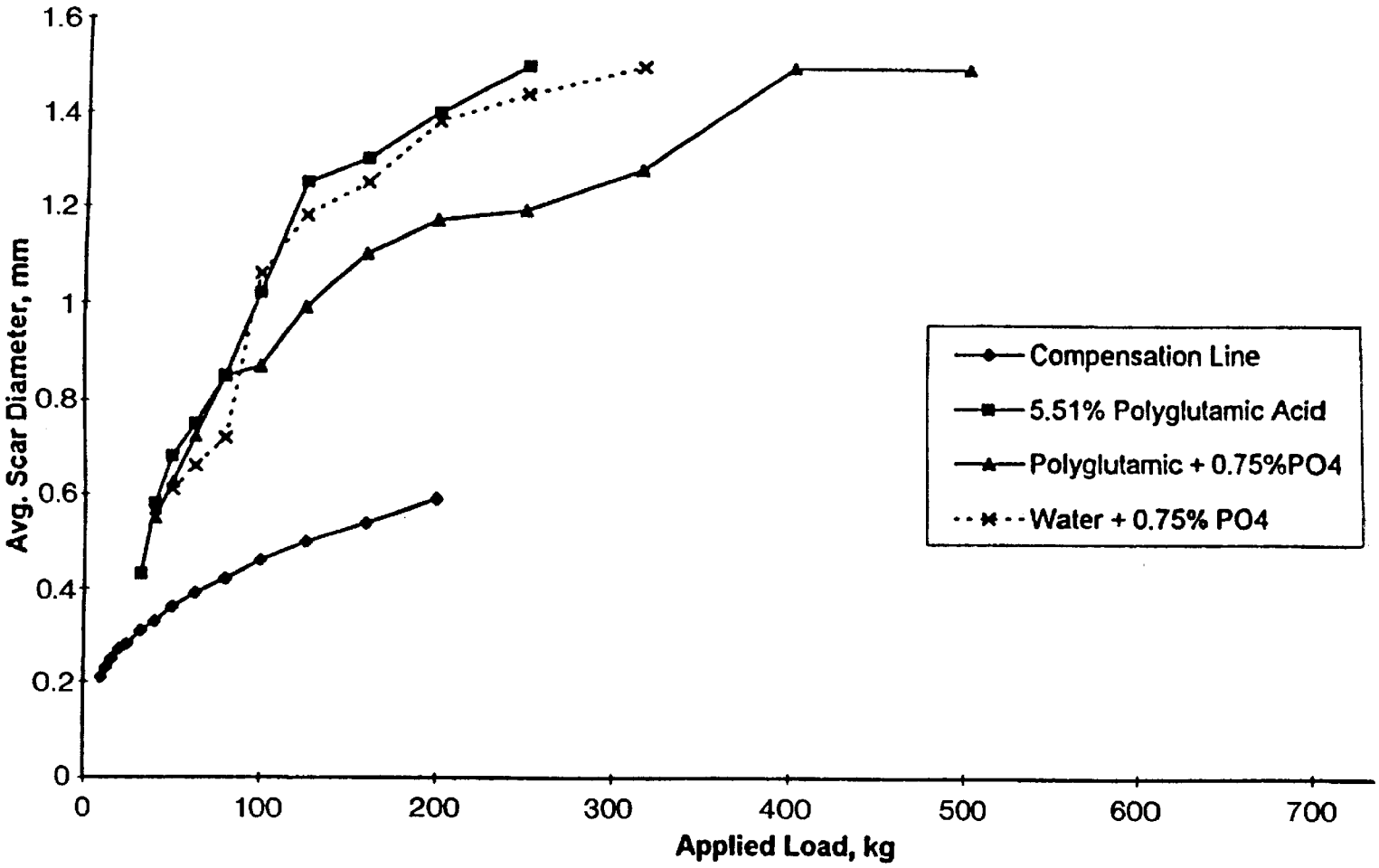
FIGS. 1–18 are plots illustrating the metal working performance of compositions of this invention in various laboratory tests.

Suitable components of Group A include, but are not limited to, carboxylic acids such as monocarboxylic acids having one to six carbon atoms functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; hydroxy carboxylic acid or a salt(s) thereof, and polycarboxylic acids, as the acids, partially neutralized acids or salts which carboxylic acids can be conveniently represented by the formulas $$R_1CO_2H \tag{I}$$

wherein connection with formula (I), $R_1$ is hydrogen, or $C_{1-6}$ alkyl, or $R_1$ is $R_aOR_b$, where $R_a$ is $C_{6-20}$ linear or branched alkyl, and $R_b$ is $C_{1-6}$ linear or branched alkylene, or $R_1$ is $R_cSR_d$, where $R_c$ is $C_{1-20}$ alkyl, and $R_d$ is $C_{1-6}$ alkylene or hydroxyalkylene with the proviso that these acids cannot be 2-hydroxybutryic or 3-hydroxybutryic acid, and wherein connection with formula (II), $$R_2[(CH_x)_mCHCO_2H]_n(CH_y)_oR_3 \tag{II}$$

$R_2$ and $R_3$ are selected as the same or different and may be independently hydrogen or oxygen, or an organic group including alkyl, aryl, mercapto, thio or dithioorganic moieties, hydroxy, hydroxyalkyl, alkenyl, alkoxy, alkoxyalkyl, or aromatic when employed in formula (II); y is numerically independent integer either 1 or 2; m is zero to about 40; o is about zero to about 18; and n is 1 to about 5,000 to 7,000 or more; m is zero to about 30 and m, o and n are independent integers except that $R_1$ cannot be 3-carboxypropyl or a carboxymethyl substituted alkyl.

As employed herein, the term "alkyl" includes but is not limited to $C_1$–$C_{30}$ alkyl, substituted and unsubstituted, linear and branched, functionalized and nonfunctionalized alkyls and includes also alkyl ethers and alkyl polyethers, mixtures thereof and the like. Those of skill in the art will recognize after reading this specification that alkyl chain lengths above 30 may be employed. As employed herein the term "aryl" includes, but is not limited to, phenyl, substituted phenyl, biphenyl(s) and diphenyl ether, mixtures thereof and the like. Subscripts such as m, n, o, x and y, are conveniently employed herein are integers and vary independently from formula to formula and within formulas. Structure formulas employed herein are used to illustrate the various components and are not meant to limit the invention.

Illustratively, non-limiting examples of carboxylic acids and salts useful herein include formic acid, dithiodipropionic acid, polyacrylic acid, thioglycolic acid, lactic acid, 1,2,3,4-butanetetracarboxylic acid, oxalic acid, malonic acid, succinic acid, glutaric acid, adipic acid, dodecanedioic acid, glycolic acid, glyoxylic acid, glyceric acid, propanetricarboxylic acid, tricarboxyhexane, tartaric acid, ricinoleic acid, lactic acid, 3-dodecyloxypropionic acid, 3-octyloxypropionic acid, phosphonobutanetricarboxylic acid, a salt(s) thereof, mixtures thereof and the like.

Other useful non-limiting carboxylic acid(s) include the group comprising of N-phosphonomethylglycine and water soluble salts and esters; lactic acid, formic acid, glycolic acid, glyoxylic acid, glyceric acid, octylthiobutyric acid, octylthiopropanoic acid, octyloxypropanoic acid, decyloxypropanoic acid, dodecyloxypropanoic acid, 4-methylthio-2-hydroxy-butyric acid, and salts and esters thereof and mixtures thereof and the like and is a polycarboxylic acid selected from the group consisting of polyacrylic acid, butanetetracarboxylic acid, oxalic acid, malonic acid, succinic acid, glutaric acid, adipic acid, pimelic acid, suberic acid, azelaic acid, dodecanedioic acid, undecanedioic acid, propanetricarboxylic acid, tartaric acid, sebacic acid, maleic acid, fumaric acid, citric acid, itaconic acid, citraconic acid, tartaric acid, malic acid, aconitic acid, and brassylic acid and tricarboxyhexane(s) and salts and esters thereof and the like.

Illustratively, non-limiting examples of salts of carboxylic acids useful herein include, but are not limited to, those such as the alkali metal, ammonium,and phosphonium salts, mixtures thereof and the like, including sodium, potassium and the like and mixtures thereof.

Also useful are carboxylic acid(s) containing two or more carboxylate moieties, if desired. The carboxylic acid may be a polymer with repeating units which has carboxylate groups.

Illustrative suitable amino acids useful herein as a component of Group A include, but are not limited, to both the naturally occurring amino acids and manufactured synthetic amino acid(s) containing at least one each of a carboxylic acid group and an amine group and which are conveniently represented by the formulas:

$$R_4(CHNH_2CO_2H)_r \text{ or} \quad (III)$$

$$R_5[(CH_x)_m(CHNH_2CO_2H)_n]_o(CH_y)_pR_6 \quad (IV)$$

$$R_5[(CH_x)_m(CHNH_2(CH_2)_zCO_2H)_n]_o(CH_y)_pR_6 \quad (IVA)$$

where $R_4$, $R_5$ and $R_6$ in formulas (III) and (IV) are either the same or different independently and may be independently hydrogen, alkyl or aryl; carboxyl; carboxymethyl; hydroxyalkyl; or amine; or sulfide; or mercaptan; phosphorus moieties; x, y, and z as employed in these formulas (III) and (IV) are the same or different independently and either 1 or 2, m, and p as employed in these formulas are the same or different integers independently and are in the range from 0 to 6 and r is an integer varying independently from one to ten. However, n and o must be at least one but can be integers from one to six independently, salts or esters thereof.

Typical useful non-limiting examples of suitable amino acids useful in practicing this invention include acidic amino acids, basic amino acids, neutral amino acids, and mixtures thereof which are conveniently representative also of the immediately above described group.

Methionine hydroxy analog or a salt thereof is a useful amino acid herein.

Typical useful acceptable non-limiting acidic amino acids useful in practicing this invention include aspartic acid, including L-aspartic, D-aspartic and D,L-aspartic; and glutamic acid including L-glutamic, D-glutamic, D,L-glutamic; N-phosphonomethylglycine, its salt(s) and ester(s), N,N-di(2-carboxymethyl)-N-methylphosphonic acid mixtures thereof and the like.

Those of skill in the art will know that for purposes of metal working that the optical activity is not important meaning that the D, L, meso, racemic and other isomers function equally well.

Monocarboxylic acid(s) having one to six carbons functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid and hydroxy carboxylic acid(s) or a salt(s) thereof show extreme pressure lubrication.

Typical useful acceptable non-limiting examples of basic amino acids useful herein include arginine, histidine, tryptophan, ornithine, mixtures thereof and the like. Provided that when lysine, an amino acid, is employed as a component of Group A, then a borate may be employed as a component of Group B.

Illustrative useful non-limiting examples of acceptable sulfur containing amino acids of Group A which are useful herein in practicing this invention include cysteine, cystine, methionine, methionine hydroxy analog, homocysteine, felinine, isovalthine, penicillamine, vitamin-U, (methyl methionine sulfone chloride) mixtures thereof, mixtures thereof, a salt(s) thereof and the like.

Other useful non-limiting amino acids which may be employed herein for illustration purposes include but are not limited to an amino acid or salt(s) thereof, a basic or a natural amino acid or a salt(s) or mixture of salt(s) thereof. Alanine, tyrosine, asparagine, valine, glutamine, glycine, hydroxyproline, isoleucine, leucine, phenylalanine, serine, threonine, thyroxine, phosphoserine, norleucine, norvaline, mixtures thereof, salts thereof and the like may be used herein.

Useful acidic amino acid(s) comprise aspartic acid and glutamic acid and isomers and racemic forms thereof and N,N-(2-carboxymethyl)N-methylphosphonic acid, N-phosphonomethylglycine, salt derivatives, and esters, O-phosphoserine and mixtures thereof.

Useful basic amino acid(s) comprise a basic amino acid selected from the group consisting of arginine, histidine, ornithine, and tryptophan and mixtures thereof and the like.

Illustratively, non-limiting useful amides of Group A which may be employed herein include those amides and polyamides which are water soluble as the compound or as its salt and where the nitrogen may be substituted or unsubstituted, and some of which are represented conveniently by the formula:

$$R_7CONR_8R_9 \quad (V)$$

where $R_7$, $R_8$ and $R_9$ as employed in formula (V) can be independently hydrogen, alkyl, aryl, a functionalized alkyl or functionalized aryl groups, $NH_2$, $NHR_{10}$, or $NR_{11}R_{12}$, where $R_{10}$, $R_{11}$, and $R_{12}$ can be the same or different and are independently hydrogen, alkyl, functionalized alkyl, aryl, or functionalized aryl groups, are functional groups containing alkylaryl groups with the provision that $R_8$ and $R_9$ may not be polyethyleneimine, wherein when $R_7$ is MOOC $(CH_2)_8$—, $R_8$ and $R_9$ may not be $C_{1-4}$ hydroxyalkyl and when $R_7$ is $C_{12-18}$ alkyl, $R_8$ and $R_9$ may not be hydroxyethyl-. Furthermore, if one of $R_8$ and $R_9$ is H, and the other is $C_{3-30}$ alkyl, then $C_7$ may not be selected from —$CH_2CH_2COOH$, —CH=CHCOOH, or ortho-carboxyphenyl. When one of $R_8$ or $R_9$ is H, and the other is $CH_2CH_2CH_2CH(NH_2)COOH$, then $R_7$ may not be an alkyl group containing from 8 to 22 carbon atoms. The polyamides include both molecules containing two or more amide groups and polymers in which amide moieties are contained in the repeating units wherein M as used above, varies independently from formula to formula throughout this specification, but is defined such as in Formula XI, page 15.

Non-limiting useful examples "functionalized alkyl" include 4-carboxybutyl, 4-butyl-1-sulfonic acid, 4-phosphonobutyl aspartyl, mixtures thereof and the like.

Non-limiting examples of useful acceptable amides for practicing this invention include but are not limited to asparagine, maleamic acid, urea, biuret, polyasparagine, guanidine, glutamine, polyurea, poly(2-ethyl-2-oxazoline), N,N-dimethylacetamide, oleoamide, polyvinylpyrrolidone, pyroglutamic acid, polyacrylamide, polylactams, N-cocoylglutamate, nonylamidoadipic acid, 4-nonylamidobutylsulfonic acid or a salt(s), mixtures thereof and the like.

As employed herein, the term amide and polyamides includes, but is not limited to those amides and polyamides which may be salts of a molecule containing an amide or a polyamide or a mixtures thereof and esters of the molecule and partial salts as well. Non-limiting, illustrative examples are polyacrylamides, polyoxazoline(s) and maleamic acid which may be employed as a component from Group A. Without being bound by theory, it is believed that precursors such as mono and-diammonium maleate may be converted to maleamic acid at working temperature.

Illustratively, naturally occurring sulfur compounds of Group A useful herein include those such as the amino acids cystine, cysteine, methionine, homocysteine, felinine, penicillamine, isovalthine, vitamin-U and manufactured products and mercaptocarboxylic acids such as mercaptosuccinic acid, dimercaptosuccinic acid, 2-mercaptopropionic acid, and mercaptoacetic acid, and the like are soluble in water as either the compound or its salt are useful in practicing this invention.

Non-limiting, illustrative examples of organosulfonates of Group A useful herein include the salts of alkylbenzene sulfonates and where the alkyl and/or the phenyl ring may or may not be substituted with functional groups such as

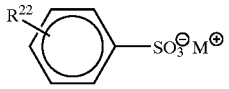

(VII)

where $R_{22}$ in formula (VII) may be independently alkyl substituted alkyl, alkoxy, hydrogen, aryl, aminoalkyl, amine, carboxyl, hydroxyl, or amide and M is independently hydrogen, alkali metal(s), ammonium, and organoammonium and mixtures thereof a salt(s) thereof, and the like.

Examples of useful non-limiting organosulfonates useful for practicing this invention include the alkali metal or ammonium salts of 4-octylbenzenesulfonic acid, 2-octylbenzenesulfonic acid, 3-octylbenzenesulfonic acid, 4-nonylbenzenesulfonic acid, 2-nonylbenzenesulfonic acid, 3-nonylbenzenesulfonic acid, 4-decylbenzenesulfonic acid, 2-decylbenzenesulfonic acid, 3-decylbenzenesulfonic acid, 4-undecylbenzenesulfonic acid, 2-undecylbenzenesulfonic acid, 3-undecylbenzenesulfonic acid, 4-dodecylbenzenesulfonic acid, 2-dodecylbenzenesulfonic acid, 3-dodecylbenzenesulfonic acid, and similar compounds containing different alkyl chain lengths, mixtures thereof and the like.

If desired, sodium or potassium sulfide or sodium or potassium hydrogen sulfide, or a mixture thereof may be employed as a component of Group A in practicing this invention.

Other useful illustrative components of Group A include but are not limited to manufactured and naturally occurring animal and vegetable derived protein mass such as glues derived from animals and albumins such as serum albumin (from blood), ovalbumin (from egg whites), lactalbumin (from milk), bovine serum albumin (BSA), bovine somatotropin (bST), 1,2-Dithia-5,8,11,14,17,20,23,26-octaazacyclononacosane, and the globulins such as those derived from animal serums, and casein. Further examples include collagen of skin, proteins derived from tendons and bones, elastins from tendons and arteries and keratin of hair, nails and horns. Other examples of proteins include the glycoproteins, phosphoproteins and chromoproteins, mixtures thereof, a salt(s) thereof and the like.

Illustrative examples of proteins or polypeptides which are polyamino acids or salt or esters thereof useful herein as a component of Group A are polyamino acids which are those polyamino acids which include homopolymers of a single amino acid, block or random copolymers of a single or two or more amino acids mixtures thereof and the like, and including but not confined to natural or synthetic proteins, oligopeptides or polypeptides. Furthermore, the illustrative amino acids may be natural or synthetic, D-or L-or racemic forms available either through synthesis or from natural protein sources, both animal and vegetable, which are water soluble as either the free polymer or as a salt, and which are described conveniently by the following representative schematic formula:

$$H[NH(CR_{23}R_{24})_mCO]_nOH \quad \text{(VIII)}$$

where m as employed in this formula (VIII) is an integer varying independently from 1 to 12, n is an integer varying independently from about 2 to about 2000, such that the amino acid remains water soluble, $R_{23}$ and $R_{24}$ as employed in this formula (VIII) are the same or different and vary within one polymer chain and for example consist independently of hydrogen or $—C_2H$, $—CH_2CO_2H$, $—CH_2CH_2CO_2H$, $—CH_3$, $—CH_2CH_3$, $CH_2CH_2CH_3$, $—CH_2CH_2CH_2CH_3$, $—CH(CH_3)_2$, $—CH_2CH(CH_3)_2$, $—(CH_2)_oX$ where o is 0 to 20 and X is any of $R_{23}$, —OH, —SH, $—SSCH_2CH(NH_2)CO_2H$, $—SCH_3$, phenyl, tolyl, hydroxyphenyl, guanidinyl, pyrrolidinyl, $NH_2$, imidazoyl, indolyl, acetoamido, mixtures thereof and the like. Non-limiting examples of useful suitable polyamino acids include polyglutamic acid, polyasparagine, polyaspartic acid and poly(aspartic/glutamic) copolymers, polyproline, or a copolymer of proline with another amino acid or a salt(s) thereof.

Illustrative, non-limiting sulfone acids may be employed as a component from Group A in this invention including those of the formula:

$$R_{27}SO_2R_{28}G \quad \text{(X)}$$

where $R_{27}$ is selected from linear or branched, substituted or unsubstituted, alkyl, alkenyl, alkoxyl, alkylamino groups having 6 to 20 carbon atoms optionally containing one or more oxygen atoms, and $R_{28}$ is absent or selected from linear or branched, unsubstituted or substituted alkylene or alkenylene, alkoxyl, alkylamino groups containing 1 to 6 carbon atoms optionally containing one or more oxygen atoms and G is selected from $—CO_2M$, $—OSO_3M$, $—SO_2OM$, $—OPO(OM)_2$, or $—PO(OM)_2$ where M in connection herewith is H, alkali metal cation, alkaline earth metal cation, ammonium.

Non-limiting examples of sulfone acids useful for practicing the invention as a component of Group A include the alkali metal or ammonium salts of octylsulfonylpropionic acid, dodecylsulfonylbutyric acid, dodecylsulfonylpropionic acid, N-octylsulfonyl-beta-alanine, nonylaminosulfonylpropionic acid.

Illustrative, non-limiting keto acids of the formula $$R_{29}C(=O)R_{30}G \quad \text{(XI)}$$

are useful herein as a component of Group A where $R_{29}$ is selected from hydrogen, linear or branched, substituted or unsubstituted, alkyl, alkenyl, alkoxyl groups having 6 to 20 carbon atoms optionally containing one or more oxygen atoms, and $R_{30}$ is absent or selected from hydrogen, linear or branched, unsubstituted or substituted alkylene or alkenylene, alkoxy groups containing 1 to 6 carbon atoms optionally containing one or more oxygen atoms and G is selected from $—CO_2M$, $—OSO_3M$, $—SO_2OM$, $—OPO(OM)_2$, or $—PO(OM)_2$ where M is H, (hydrogen), alkali metal cation, alkaline earth metal cation, and organoammonium, ammonium, mixtures thereof and the like.

Non-limiting, illustrative examples of keto acids useful for practicing this invention include alkali metal or ammonium salts of octylsuccinate, decylsuccinate, dodecylsuccinate, and 5-oxo-hexadecanoic acid, mixtures thereof and the like. Illustrative, non-limiting amine substituted organo acids of the formula $$R_{31}N(R_{33})R_{32}G \quad \text{(XII)}$$

are useful herein as a component of Group A where $R_{31}$is selected from hydrogen, linear or branched, substituted or unsubstituted, alkyl, alkenyl, alkoxyl groups having 6 to 20 carbon atoms optionally containing one or more oxygen atoms, and $R_{32}$ is absent or selected from hydrogen, linear or branched, unsubstituted or substituted alkylene or alkenylene, alkoxy, and alkylamino groups containing 1 to 6 carbon atoms optionally containing one or more oxygen atoms and $R_{33}$ is selected from H, linear or branched, substituted or unsubstituted alkyl or alkenyl groups having 6 to 20 carbon atoms optionally containing one or more oxygen atoms, and G is selected from —$CO_2M$, $OSO_3M$, —$SO_2OM$, —$OPO(OM)_2$, or —$PO(OM)_2$ where M is H, alkali metal cation, alkaline earth metal cation, organoammonium, ammonium mixtures thereof and the like with the proviso that when G in the compound above represented by the structure shown in formula (XII) is sulfonate, $R_{31}$ and $R_{33}$ are not hydrogen.

Non-limiting, illustrative examples of amine substituted organo acids of formula (XII) for practicing this invention include the alkali metal or ammonium salts of octylaminobismethylene phosphonic acid and dodecylaminobismethylene phosphonic acid. Illustrative substituted amino acids of the formula:

(XIII)

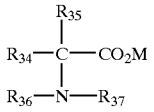

are useful herein as a component of Group A wherein the compounds of formula (XIII) represent an extension of the amino acids wherein $R_{34}$, $R_{35}$, $R_{36}$, and $R_{37}$ may be hydrogen, alkyl, aryl, functionalized alkyl, functionalized aryl, alkanol, polyalkoxy, alkenyl, sulfur containing moieties, and phosphorus containing moieties. Additionally, $R_{34}$ and $R_{36}$ may be covalently connected such as in cyclic amino acids like proline. M is a symbol for a moiety which is conveniently selected from hydrogen, alkali metals cation, ammonium, or organoammonium, mixtures thereof and the like. Illustrative, non-limiting substituted acids of the formula $$R_{38}XR_{39}G \quad \text{(XIV)}$$

where $R_{38}$ is selected from linear or branched, substituted or unsubstituted, alkyl or alkenyl groups having 6 to about 20 carbon atoms optionally containing one or more oxygen atoms, and X is absent or selected from the group consisting of —$CH_2$— (methylene), oxygen, sulfur, —S—S—, and aryl where aryl is unsubstituted or substituted phenyl, and $R_{39}$ is absent or selected from linear or branched, unsubstituted or substituted alkylene or alkenylene groups containing 1 to 6 carbon atoms optionally containing one or more oxygen atoms and G is selected from —$OSO_3M$, —$SO_2OM$, —$OPO(OM)_2$, or —$PO(OM)_2$ where M is H, alkali metal cation, alkaline earth metal cation, ammonium with the with the proviso that:

1. when X is aryl and $R_{35}$ is absent, G cannot be $SO_2OM$ and
2. when X is absent or methylene, G cannot be $PO(OM)_2$ and
3. when G is a phosphate then $R_{38}$ cannot be substituted with phosphate and
4. when X is absent or methylene or oxygen, G cannot be phosphate and
5. when G is phosphate $R_{39}$ mut be present and X cannot be methylene and
6. when G is —$SO_2OMg$ and X is absent or methylene then $R_{38}$, $R_{39}$ cannot be alkyl or alkylene. (Mg= magnesium.)

Non-limiting, illustrative examples of mercaptocarboxylic acids useful as a component of Group A include without limitation those illustrated by the following schematic formula:

(XV)

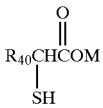

wherein $R_{40}$ includes alkyl $C_{1-30}$ and carboxyalky $C_{1-30}$, M=H, alkali metal cations, alkaline earth metal cation, ammonium, organoammonium, mixtures thereof, and the like.

Typical non-limiting, illustrative component(s) from Group B include any phosphates, phosphonates, phosphites and hypophosphites, borates, mixtures thereof, and the like. When employed in the compositions, method of use and processes of this invention these phosphates, phosphonates, phosphites, hypophosphites, orthoborates, metaborates, pentaborates, can have beneficial effects on extreme pressure lubrication in metal working operations. Reduced forms of a component or components from Group B may be useful as such and also may be oxidized in-situ by air or other oxidizing agent. For example, phosphites may be oxidized to phosphates. Such beneficial effects are enhanced by the addition of these components to the organic compounds of Group A described herein above.

Non-limiting, illustrative most preferred phosphates are orthophosphates such as either the monobasic, dibasic or tribasic salt-or mixtures thereof with an alkali metal(s), preferably a potassium or sodium, or an ammonium or alkylammonium such as triethylammonium or triethanolammonium and the like, and their full or partial esters although other similar phosphates may be employed if desired.

In addition to the orthophosphates, illustratively the following phosphates, as their salts, illustratively may be used: pyrophosphoric acid, metaphosphoric acid, phosphorous acid, hypophosphorous acid, polyphosphoric acid, phosphoserine, mixtures thereof and the like.

Some or most of the phosphonates useful herein are illustratively those compounds which can be represented conveniently by the formula:

$$R_{25}(PO(OR_{26})_2)_n \quad \text{(IX)}$$

where n in formula (IX) above is an integer varying independently from 1 to about 5, and $R_{25}$ in formula (IX) can be independently organic moiety(s) and phosphonoorganic moiety(s), or amine containing organic moiety(s) or mixtures thereof and the like and $R_{26}$ is independently one or more hydrogen or an organic moiety(s) including alkyl, aryl, polyalklylene glycols, polyethyleneglycols, polypropylene glycols, mixtures thereof, and the like.

Suitable non-limiting, illustrative examples of acceptable phosphonates which are useful herein include 1-hydroxyethylidene-1,1-diphosphonic acid, aminotri (methylenephosphonic acid), dodecylamine bismethylene-phosphonic acid, which can be made by reacting dodecylamine, formaldehyde, phosphorous acid and hydrogen chloride, (hexamethylenediaminetetra (methylenephosphonic) acid, diethylenetriaminepenta (methylenephosphonic acid), N-phosphonomethylglycine, 2-phosphono-1,2,4-butanetricarboxylic acid, hydroxy-phosphonoacetic acid, a salt(s) thereof, mixtures thereof and the like.

In preparing compositions of this invention (for example metal working compositions), the amount of a component selected from Group A, for example, is generally in the range from about 0.1% to about 75% or more by weight of the total composition and most preferably in the range from about 0.25% to about 25% by weight or more for the total composition (although one of skill in the art will recognize after reading this specification that greater or lesser amounts or concentrations can be employed if desired to attain the desired beneficial lubricant effect.

For example, when a component is utilized from Group A and a component is utilized from Group B, the amount of a component utilized from Group B is for example in the range from about 0.1 to about 60% and is preferably in the range from about 0.25 to about 15% by weight (although greater or lesser amounts can be employed as would be recognized by one of skill after reading this specification including the Examples).

In another embodiment, a method of metal working is provided which comprises contacting or communicating with the surface of the metal being worked or the surface of the tool with an aqueous solution of a fluid lubricant composition comprising a composition of this invention as herein described.

If desired optionally more than one component can be utilized from Group A and/or Group B depending on the specific application or in addition if desired a component from Group A can be an adduct of components from Group A and Group B whereby that resulting adduct component imparting enhanced lubricating property contains a carboxylate and a phosphorus moiety within the same molecule. See Table I.

When the component from Group A is used exclusively, the amount of such component so employed is an effective lubricating amount, typically in the range from about 0.1 to about 75% or more and preferably in the range from about 0.25% to about 25% although greater or lesser amounts may be employed as those of skill in the art will recognize as an effective amount after reading this specification.

The phosphonates illustrated above may be used as a component of Group A to achieve one or more of the objects of this invention. When a phosphonate is so employed the concentration of the phosphonate is preferably in the range from about 0.1% to about 75% or more and preferably in the range from about 0.10% to about 15% and most preferably in the range from about 0.10% to about 10% by weight although greater or lesser amounts may be employed.

This invention also comprises a method of feeding a metal working water-soluble lubricant composition to a metal needing and receptive to the same (capable of being worked) comprising preparing an aqueous solution of a metal working water soluble lubricant composition by optional dilution of a composition of an aqueous solution of a fluid lubricant composition which comprises one or more water soluble components selected from a first group (A) comprising amides; polyamides; polyamino acids, salts and esters; polycarboxylic acids, salts or their esters; amino acids, salts and esters, sulfonic acids and salts; a sulfur compound selected from mercaptan, sulfide, disulfide and polysulfide; mercaptocarboxylic acids; substituted amino acids; organosulfonates; sodium or potassium sulfide, sodium or potassium hydrogen sulfide, organic acids containing one or more moieties selected from the group consisting of carboxylate, sulfate, sulfonate, phosphate, and phosphonate, present as the free acids, or their salts; organic acids containing one or more moieties selected from the group consisting of carboxylate, sulfate, sulfonate, phosphate; and phosphonate present as the free acids or their salts; and additionally a moiety selected from the group consisting of sulfone, sulfonamide, sulfonic ester, sulfate ester, ketone, carboxylic ester, amide, amine, ether, sulfide, disulfide, or aryl; and optionally one or more components selected from a second Group (B) comprising phosphates, borates, phosphonates, phosphites and hypophosphites, preferably with the balance being water and feeding the water soluble composition to the work portion of a metal by spraying or dripping said metal working water soluble composition. Illustratively, in using this invention, a lubricated metal surface is provided wherein said surface of said metal being worked and/or the surface of the tool is lubricated with a composition of this invention. Illustratively, such lubrication is brought about by any convenient means such as dripping, wetting and otherwise similarly providing or feeding in some acceptable fashion a composition of this invention to the surface of the metal being worked so it is utilized to produce a metal worked piece also in accordance with this invention.

The temperature at which composition of this invention may typically be applied is preferably a suitable temperature, for example, such as might be arrived at by those of skill in the art and illustratively, but non-limiting, may be in the range from about 32 F. to about 212 F. or more or less as measured in the fluid. Those of skill in the art will recognize that the temperature in the zone of the metalworking and of the tool and the metal being worked will necessarily become significantly hotter during the metal working. If desired, a metal may be worked by a tool using a composition of this invention whereby the metal is cleaned first and then this invention practiced on the metal.

Those of skill in the art will recognize that various water soluble additives may be employed in compositions of this invention to enhance or contribute properties which enable broader functions with respect to the use of the compositions in metal working applications. The types of additives which are readily apparent to those skilled in the art include simple film forming lubricants and/or boundary lubricants, corrosion inhibitors, oxidation inhibitors, detergents and dispersants, viscosity index improvers, emulsion modifiers, antiwear and antifriction agents and foam depressors.

For example, additives may be employed to enhance boundary lubrication such as wear inhibitors, lubricity agents, friction modifiers and the like. Typical examples of such additives are metal dialkyl dithiophosphates, metal diaryl dithiophosphates, alkyl phosphates, tricresyl phosphate, 2-alkyl-4-mercapto-1,3,4-thiadiazole, metal dialkyl-dithiocarbamates, metal dialkyl phosphorodithioates wherein the metal is typically zinc, molybdenum, tungsten or other metals, phosphorized fats and olefins, sulfurized fats and olefins and paraffins, fatty acids, polyalkoxylated fatty acids, alkylene oxides, polyethylene oxides, polypropylene oxides, carboxylic acids and their salts, esters of fatty acids including partially hydrolyzed castor oil, organic molybdenum compounds, molybdenum disulfide, graphite and borate dispersions. Such boundary lubrication additives are well known in the art. Other additives include detergents and dispersants which provide cleaning functions.

Although the fluid compositions of this invention function as corrosion inhibitors in a certain range of pH, corrosion inhibitors may be employed in compositions of this invention which will function in a pH range in which another ingredient may not function as a corrosion inhibitor. Suitable examples of corrosion inhibitors include polyamino acids and phosphonates such as $C_{12}H_{25}N(CH_2PO_3H)_2$. Typical examples of corrosion inhibitors known in the art are benzotriazole, tolyltriazole, other functionalized benzotriazoles, zinc chromate, dithiophosphates such as zinc dithiophosphate, metal sulfonates wherein the metal is an alkali metal, alkanolamines such as monoethanolamine and triethanolamine and substituted alkanolamines wherein the backbone of the alkyl group is substituted to provide various properties, alkyl amines such as hexylamine and trioctylamine, borate compounds such as sodium or potassium tetraborate or potassium pentaborate, and mixtures of borates with amines, carboxylic acids including polyaspartic acid at high pH (about 10 and above) and alkyl amino carboxylic acids particularly useful in hard water, sodium molybdate, boric acid esters such as monobenzyl borate and boric acid with various ethanolamines (also acting as a biostat), caprylic acid, nonanoic acid, benzoic acid, nitro derivatives of benzoic acid, a,w-diacids such as sebacic acid, ammonium benzoate, mucic acid, hydroxybenzoic acid, sodium benzoate, triethanolamine salts of carboxylic acids with a carboxymethyl thio group such as 1-1-(carboxymethylthio)undecanoic acid triethanolamine salt. Other corrosion inhibitors include 1-methylimidazole, 1-(3-aminopropyl)imidazole, 1,2-dimethylimidazole, mixtures thereof and the like, amines and substituted amines such as 2,2'-ethylenedioxy-bis(ethylamine), tris(2-aminoethyl) amine, N,N,N',N'-tetrakis(2-hydroxyethyl)ethylendiamine, and longer chain mono-, di-, and triamines such as 4-(aminomethyl)-1, 8-octanediamine, iminobispropylamine, bishexamethylene-triamine, trioctyl amine, and polyethyleneimine, mixtures thereof and the like. An additional class of inhibitors are biological buffers such as 3-[N,N-bis(2-hydroxyethyl(amino]-2-hydroxypropanesulfonic acid. Additionally, basic amino acids such as lysine and ornithine could also be added to provide corrosion inhibition. Lysine and ornithine are non-toxic and biodegradable and readily absorbed by the environment. A more thorough review of corrosion inhibitors are provided by Aruna Bahadur in a publication entitled "Chromate Substitutes For Corrosion Inhibitors in Cooling Water Systems" appearing in Corrosion Reviews, 11(1–2), pp. 105–122, 1993 which is incorporated herein by reference in its entirety.

These fluids may be employed in metal working processes for both ferrous and non-ferrous metals if desired. Tests with non-ferrous metals such as brass, copper, aluminum, and titanium indicate that the work piece remains relatively free of discoloring deposits. It has been observed that the aqueous solutions of the salts of polyaspartic acid are corrosion inhibitors for ferrous metals as indicated by U.S. Pat. No. 4,971,724 to Kalota et al. Therefore, metals, particularly ferrous metals, are free of harmful deposits and are, in fact substantially protected from corrosion by the metal working fluids of this invention.

The water-based metal working fluid compositions of this invention are particularly advantageous in that there is little or no odor associated with their water solutions. Further, it has been observed that these fluids do not create a mist around the tool working area as is common with water-based oil containing fluids. Because of the lack of mist formation the work area is maintained virtually free of deflected fluid leaving the machinery and worker substantially free of contamination by the metal working fluid. The cost advantages of such a fluid are obvious in alleviating environmental concerns resulting in alternative means of disposal.

The metal working fluids of this invention are useful in the various metal working applications such as were noted above with any number of types of metals. In particular they are useful in working ferrous metals such as iron, steel (carbon steel and low alloy carbon steel), and stainless steel and nickel-based alloys. Non-ferrous metals which can be worked with fluids of this invention are copper, brass, aluminum, magnesium, zirconium, and titanium. In addition, alloys or composites made from such materials as cobalt or nickel cemented tungsten carbide may also be worked or formed using components in this invention. $C_{12}H_{25}N(CH_2PO_3H)_2$ (dodecylamine bismethylene phosphonic acid) may be conveniently utilized when working aluminum metal as a component of Group B. Also polyalkylene oxide derivatives of fatty acids such as ricinoleic acid may be utilized. Such metals are safely worked with lubricity supplied by the water based fluids of this invention.

A particularly important function of a metal working fluid of this invention in cutting operations is the function of cooling so as to maintain lower temperature of the tool as well as the work temperature. Such control aids in minimizing tool wear and distortion of the work piece. Another function of the metal working fluid of this invention is lubrication which may reduce friction as between the tool and chips produced during the cutting operation as well as reduction of the friction between the tool and the work piece. In cutting operations of various types there are typically produced chips of small pieces of metal which are advantageously carried away from the work piece as soon as possible so that they do not jam the cutting tool.

As used herein, "water soluble" also includes, but is not limited to, the condition in which a substance forms a homogeneous transparent solution in water. Useful components in compositions of this invention include those wherein the component of Group A alone or the combination of a component Group A and a component of Group B are water soluble.

As used herein, the term "metal working" is not limiting but includes illustratively without limiting such processes as cutting, grinding and forming processes and similar processes and the like. According to M. C. Shaw, "Principles of Abrasive Processing", Clarendon Press, Oxford, 1996, which is incorporated herein in its entirety by reference, which discloses some metalworking aspects, the field of grinding is divided into two regimes, "stock removal grinding" and "form and finish grinding". The first regime involves those processes in which the main objective is to remove unwanted material without regard for the quality of the resulting surface. The second regime involves those operations in which form and finish are a major concern and wheels must be periodically dressed to provide sharp cutting edges that are relatively free of adhering metal and wear flats. Our invention relates to all types of grinding and forming. Illustratively, some of the types of grinding are rough grinding, precision grinding, surface grinding, cylindrical grinding, centerless grinding, internal grinding, creep feed grinding and tool grinding and the like.

Some of the metal cutting or metal removal operations include illustratively, without limit, turning, milling, honing, drilling, sawing, reaming, broaching, tapping, planing, boring, threading and the like. Illustrative, non-limiting types of operations are presented in M. C. Shaw, "Metal Cutting Principles", Clarendon Press, Oxford, 1984 which is incorporated herein in its entirety by reference. Metal removal processes are considered a type of forming but involve forming by removal of metal.

Forming processes typically have to do with the shaping of metal without its removal. Some nonlimiting illustrative examples are coining, explosive tube forming, cogging, roll forming, bar forging, tube rolling, bending, stamping, and drawing among others. Such processes typically require high pressures which are believed to induce plasticity into the metal at the point of "working" and are accompanied by increased temperatures. Without being bound by theory, it is believed that the extreme pressure portion of the package reacts chemically with the metal surface during either a pretreatment of the surface or during the metal working operation. It is likewise further believed that lubrication occurs through the removal of the chemically reacted film through contact. It is also believed that the film is regenerated by further reaction. The technical reference J. P. Byers, "Metalworking Fluids", Marcel Decker, Inc., NY, 1994 is informative on this point and is incorporated herein in its entirety by reference.

Also as employed herein, the term "metal working" encompasses but is not limited to a process or processes using a tool performing the metal working to a piece and/or a piece itself being metal worked and receiving the actions of a tool.

As used herein, the term "polycarboxylic" includes carboxylic acids or salts or esters thereof containing two or more carboxylate moieties.

As employed herein, added functional effects, include but is not limited to, the combined extreme pressure lubricating effect of Group A and Group B components was greater than obtained from either component alone.

Those of skill in the art will recognize that cations such as sodium, potassium, ammonium, organoammonium and the like are employed in compositions and methods of this invention (with various components of Group A and Group B) as counterion(s) of an anion(s) the latter of which might be responsible in some way for the enhanced property without being bound by theory. (Such as lubrication).

This invention also comprises of a method for metal working, wherein said method comprises providing as a lubricant to said metal, a lubricating effective amount of a fluid lubricant composition comprising one or more water soluble components selected from: a first Group (A) comprising:

amides; polyamides; polyamino acids, salts and esters; monocarboxylic acid having one to six carbons functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid with the proviso that these acids cannot be 2-hydroxybutryic or 3-hydroxybutryic acid; polycarboxylic acids, salts or their esters; amino acids, salts and esters, sulfonic acids and salts; a sulfur compound selected from mercaptan, sulfide, disulfide and polysulfide; and mercaptocarboxylic acids, salts and esters; amine substituted organic acids, salts and esters; substituted amino acids, salts or esters; organosulfonates; sodium or potassium sulfide, sodium or potassium hydrogen sulfide, organic acids containing one or more moieties selected from the Group consisting of carboxylate, sulfate, sulfonate, phosphate, and phosphonate, present as the free acids, or their salts; organic acids containing one or more moieties selected from the group consisting of carboxylate, sulfate, sulfonate, phosphate; and phosphonate present as the free acids or their salts; and additionally a moiety selected from the Group consisting of sulfone, sulfonamide, sulfonic ester, sulfate ester, ketone, carboxylic ester, amide, amine, ether, sulfide, disulfide, or aryl; and optionally one or more components selected from a second Group (B) comprising:

phosphates, borates, phosphonates, phosphites and hypophosphites, and which composition provides a synergistic lubricating or added functionality effect when used in an admixture with one or more component(s) of Group (A) and Group (B).

This invention also comprises of feeding a metal working water-soluble lubricant composition to a metal useful to receive the same, comprising optionally diluting said metal working water soluble lubricant composition and feeding the optionally diluted or non-diluted water soluble composition to a portion of the metal by applying whereby said composition is effectively provided to said metal.

This invention also comprises of a method of using a metal working water soluble lubricant composition which comprises providing as a lubricant to said metal, a lubricating effective amount of a fluid lubricant composition comprising one or more water soluble components selected from: a first Group (A) comprising:

amides; polyamides; polyamino acids, salts and esters; monocarboxylic acid having one to six carbon atoms functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; polycarboxylic acids, salts or their esters; amino acids, salts and esters; sulfonic acids and salts; a sulfur compound selected from mercaptan, sulfide, disulfide and polysulfide and 2 mercaptocarboxylic acid; keto acids, salts and esters; amine substituted organic acid(s) or a salt(s) thereof; organosulfonates; sodium or potassium sulfide, sodium or potassium hydrogen sulfide, organic acids containing one or more moieties selected from the Group consisting of carboxylate, sulfate, sulfonate, phosphate, and phosphonate, present as the free acids, or their salts; organic acids containing one or more moieties selected from the Group consisting of carboxylate, sulfate, sulfonate, phosphate, and phosphonate present as the free acids or their salts, and additionally a moiety selected from the Group consisting of sulfone, sulfonamide, sulfonic ester, sulfate ester, ketone, carboxylic ester, amide, amine, ether, sulfide, disulfide, or aryl; and optionally one or more components selected from a second Group (B) comprising:

phosphates, borates, phosphonates, phosphites and hypophosphites, and which composition provides a synergistic lubricating or added functionality effect when used with one or more component(s) of Group (A) and Group (B).

This invention also comprises of a method for metal working, wherein said method comprises providing as a lubricant to said metal, a lubricating effective amount of a lubricant composition comprising of one or more water soluble components selected from: a first Group (A) comprising:

amides; polyamides; polyamino acids, salts and esters; monocarboxylic acid having one to six carbons functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; 2 polycarboxylic acids, salts or their esters; amino acids, salts and esters, sulfonic acids and salts; a sulfur compound selected from mercaptan, sulfide, disulfide and polysulfide; and mercaptocarboxylic acids, keto acids, salts and esters; amine substituted organic acid(s) or a salt(s) thereof; organosulfonates; sodium sulfide, sodium hydrogen sulfide, organic acids containing one or more moieties selected from the Group consisting of carboxylate, sulfate, sulfonate, phosphate, and phosphonate, present as the free acids, or their salts; organic acids containing one or more moieties selected from the Group consisting of carboxylate, sulfate, sulfonate, phosphate; and phosphonate present as the free acids or their salts; and additionally a moiety selected from the Group consisting of sulfone, sulfonamide, sulfonic ester, sulfate ester, ketone, carboxylic ester, amide, amine, ether, sulfide, disulfide, or aryl; and optionally one or more components selected from a second Group (B) comprising:

phosphates, borates, phosphonates, phosphites and hypophosphites, and which composition provides a synergistic lubricating or added functionality effect when used in an admixture with one or more component(s) of Group (A) and Group (B).

This invention also comprises a lubricated metal surface wherein said surface of said metal being worked has been contacted with a composition comprising an effective amount of a fluid lubricant composition comprising one or more water soluble components selected from: a first Group (A) comprising:

amides; polyamides; polyamino acids, salts and esters; monocarboxylic acid having one to six carbon atoms functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; polycarboxylic acids, salts or their esters; amino acids, salts and esters; sulfonic acids and salts; a sulfur compound selected from mercaptan, sulfide, disulfide and polysulfide; organosulfonates; sodium sulfide, sodium hydrogen sulfide, organic acids containing one or more moieties selected from the Group consisting of carboxylate, sulfate, sulfonate, phosphate, and phosphonate, present as the free acids, or their salts; keto acids, salts and esters; amine substituted organic acid(s) or a salt(s) thereof; organic acids containing one or more moieties selected from the Group consisting of carboxylate, sulfate, sulfonate, phosphate; and phosphonate present as the free acids or their salts; and additionally a moiety selected from the Group consisting of sulfone, sulfonamide, sulfonic ester, sulfate ester, ketone, carboxylic ester, amide, amine, ether, sulfide, disulfide, or aryl; and optionally one or more components selected from a second Group (B) comprising:

phosphates, borates, phosphonates, phosphites and hypophosphites, and which composition provides a synergistic lubricating or added functionality effect when used in an admixture with one or more component(s) of Group (A) and Group (B) lubrication has been provided.

This invention also comprises a worked piece of metal or a piece of metal being worked, said working being or having been accomplished by having contacted or provided to said metal with an effective amount of a fluid lubricant composition comprising one or more water soluble components selected from: a first Group (A) comprising:

amides; polyamides; polyamino acids, salts and esters; monocarboxylic acid having one to six carbons functionalized or nonfunctionalized, examples are $C_1$–$C_{20}$ alkoxy, sulfone, alkylene phosphonates, sulfide, functionalized amines and the like, salts and esters, with the proviso that this does not include the 2-hydroxybutyric acid and 3-hydroxybutyric acid; polycarboxylic acids, salts or their esters; amino acids, salts and esters; sulfonic acids and salts; a sulfur compound selected from mercaptan, sulfide, disulfide and polysulfide and mercaptocarboxylic acids, salts and esters; substituted amino acids, salts or esters; organosulfonates; sodium or potassium sulfide, sodium or potassium hydrogen sulfide, keto acids, salts and esters; amine substituted organic acid(s) or a salt(s) thereof, organic acid(s) containing one or more moieties selected from the group consisting of carboxylate, sulfate, sulfonate, phosphate, and phosphonate, present as the free acids, or their salts; organic acids containing one or more moieties selected from the Group consisting of carboxylate, sulfate, sulfonate, phosphate, and phosphonate present as the free acids or their salt, and additionally a moiety selected from the Group consisting of sulfone, sulfonamide, sulfonic ester, sulfate ester, carboxylic ester, ketone, amide, amine, ether, sulfide, disulfide, or aryl; and optionally one or more components selected from a second Group (B) comprising:

phosphates, borates, phosphonates, phosphites and hypophosphites, and which composition provides a synergistic lubricating or added functionality effect when used in an admixture with one or more component(s) of Group (A) and Group (B) to produce said article of manufacture.

One of skill in the art will know how to make and use the compositions disclosed herein after receiving this specification. The composition of claim 1 wherein the component of Group A is a salt or mixtures thereof, or the component of Group B is a salt or mixtures thereof, or both components of Group A and Group B is a salt or a mixture thereof or neither component of Group A or Group B is a salt.

The 1,3,6-tricarboxyhexane was prepared by hydrolyzing tricyanohexane with potassium hydroxide in water. The tricyanohexane was obtained as a co-product from the electrohydrodimerization of acrylonitrile.

In preparing a composition of this invention one of skill in the art will typically add a component from Group A optionally to a component of Group B to form an admixture in a selected quantity of water. There is no preferred order with respect to mixing or order of addition. The temperature at which a composition may be prepared may be ambient and pressure normal atmospheric. Use of a water soluble component(s) is required.

Those of skill in the art will recognize that an effective quantity of a functional moiety component (lubricant) from Group A and optionally Group B are present in a composition of this invention in order to achieve the objects of this invention. This may be provided in acid, salt, ester or a mixture of forms, such as an ionic form (such as a salt(s)). The amount provided is such that a functional lubricating effective amount is provided in a composition, a method of use, or an article of manufacture prepared using the invention. Illustratively but not limiting, an effective amount of lubricant is that amount of lubricant which adequately lubricates the surface of the metal being worked or tool working the metal for example and achieves the objectives of a quality lubricant as would be recognized by those of skill in the art. When a component from Group A is employed without a component from Group B, those of skill in the art will recognize that an aqueous solution containing an effective lubricating amount of the component from Group A may be applied to the surface of the metal or tool being lubricated. This invention also comprises compositions where a component of Group B is used with a component from Group A. In those situations an effective lubricating amount of a component from Group B is employed along with an effective amount of a component of Group A. Components illustrated in the EXAMPLES are available commercially except were noted.

EXAMPLES

Example 1

An Extreme-Pressure Four-Ball Test was conducted according to the procedure of ASTM D2783, "Standard Method for Measurement of Extreme-Pressure Properties of Lubricating Fluids (Four-Ball Method)" incorporated herein by reference in its entirety. This test is used to rank the relative load carrying properties of lubricating fluids under a constant set of conditions. In this test, one steel ball is rotated under load against three steel balls held stationary. The test lubricant covers the lower three balls. The load is increased on the rotating ball as the test progresses and scar diameter measurements on the balls are made for ten ascending loads below the weld-point. The data is reported in Table 1 below as load wear index (kgf), average scar diameter (mm), and weld point (kgf). The load wear index is calculated from the tabulation of scar diameter versus applied load. The corrected applied loads (compensating for Hertzian diameter) of the largest 10 loads immediately preceding the weld point are averaged. Since the scar diameters are always measured at the same applied loads, the index becomes a function of the fluid and metals. Since all tests are conducted with the same metal type the load wear index is used to rank the abilities of a series of lubricants to minimize wear.

Table 1 is a set of data which has been generated running the previous two tests and which reports data for the four ball extreme pressure test as Mean Hertz Load, Welding Load, Non-seizure Load and Scar Diameter for the extreme pressure Four-ball test and data is reported for coefficient of friction. Note that Max load and torque values were generated as a result of running ASTM method D2783.

These data indicate that compositions of this invention are highly useful in metal forming and metal working operations.

ASTM test D3233B, "Standard Test Methods for Measurement of Extreme Pressure Properties of Fluid Lubricants (Falex Pin and Vee Block Methods)" incorporated herein by reference in its entirety, was run at a fluid temperature of 49C. at 290 rpm and a concentration by weight which provides 365 milliequivants/L of the component shown below for most examples.

The test component was generally dissolved in a container to provide 365 milliequivalents/Liter in water with and without phosphate at a level of about 0.75% or about 1.50% as orthophosphate with the balance of the composition being water. These test materials were evaluated using the ASTM D2783 Extreme Pressure Four ball test and the ASTM D3233B Pin and Vee block test.

Classes of components useful in practicing this invention for metal working are contained in the following Table 1. (Except wherein indicated otherwise, when a salt was employed herein, the potassium salt was used. The pH was typically about 9.5 to 10).

In the interpretation of the results of ASTM D-2783, a weld point of 250 to 400 kg-f is considered to be high extreme pressure capability with a value of 315 being average for high extreme pressure fluids. Values of 500 kg-f and greater are considered higher than normally encountered high extreme pressure behavior. The maximum load of the test is 800 kg-f.

TABLE I

Four-ball extreme pressure and pin and vee block evaluation of several classes of compounds in water.

| | | | ***ASTM D2783 4-ball Extreme Pressure Test**** | | | | ASTM 3233 Extreme Pressure ****Pin & Vee Block Test** | | |
|---|---|---|---|---|---|---|---|---|---|
| Compound | Compound meq./L | $K_2HPO_4$ as wt % $PO_4$ | Load Wear Index Kg | Welding[1] Load Kg | Last Non-seizure Load Kg | Scar diameter for last load before weld mm | Coefficient of friction | Max load[2] K lbs | torque inch-lbs |
| water | | 0 | 10.8 | 126 | na | 2.97 | | | |
| water | | 0 | 12.2 | 126 | na | 2.79 | 0.25 | 0.605 | 7 |
| water | | 0.05 | 13.8 | 126 | na | 2.87 | | | |
| water | | 0.4 | 24.41 | 200 | na | 1.75 | 0.23 | 2.549 | 131 |
| water | | 0.75 | 56.2 | 400 | na | 1.5 | | | |
| water | | 0.75 | 56.4 | 400 | na | 1.79 | 0.19 | 2.5 | 112 |
| water | | 0.75 | 58.1 | 400 | na | 1.54 | 0.23 | 2.612 | 105 |
| water | | 1.5 | 63.3 | 400 | na | 1.45 | | | |
| 2.48% sodium formate | 365 | 0 | 26.59 | 250 | na | 2.52 | | | |
| 2.48% sodium formate | 365 | 0.75 | 61.54 | 400 | na | 1.47 | | | |
| 3.29% lactic acid | 364 | 0 | 22.42 | 160 | na | 1.68 | | | |
| 3.29% lactic acid | 364 | 0.75 | 76.43 | 500 | na | 1.86 | | | |
| 4.6% 4-hydroxybutyric acid | 365 | 0 | 20.4 | 160 | na | 1.64 | 0.09 | 4.5 | 85 |
| 4.6% 4-hydroxybutyric acid | 365 | 0.75 | 63.3 | 400 | na | 1.49 | 0.1 | 4.418 | 102 |
| 11.1% octanoic acid | 771 | 0 | 23.62 | 126 | 24 | 1.62 | 0.06 | 3.709 | 48 |
| 11.1% octanoic acid | 771 | 0.75 | 70.73 | 400 | na | 1.25 | 0.05 | 4.356 | 45 |
| 10.89% ricinoleic acid | | 0 | 32.8 | 126 | 50 | 2.05 | 0.16 | 3.099 | 45 |
| 10.89% ricinoleic acid | | 0.75 | 48 | 250 | 32 | 1.24 | 0.05 | 3.815 | 43 |

TABLE I-continued

Four-ball extreme pressure and pin and vee block evaluation of several classes of compounds in water.

| | | | ***ASTM D2783 4-ball Extreme Pressure Test**** | | | | ASTM 3233 Extreme Pressure ****Pin & Vee Block Test** | | |
|---|---|---|---|---|---|---|---|---|---|
| Compound | Compound meq./L | $K_2HPO_4$ as wt % $PO_4$ | Load Wear Index Kg | Welding[1] Load Kg | Last Non-seizure Load Kg | Scar diameter for last load before weld mm | Coefficient of friction | Max load[2] K lbs | torque inch-lbs |
| 3.5% sodium polyglyoxylate | 364 | 0 | 22.38 | 160 | na | 1.44 | | | |
| 3.5% sodium polyglyoxylate | 364 | 0.75 | 59.37 | 400 | na | 1.52 | | | |
| 2.74% DL-tartaric acid | 364 | 0 | 40.8 | 315 | na | 1.61 | 0.11 | 4.5 | 109 |
| 2.74% DL-tartaric Acid | 364 | 0.75 | 87.65 | 620 | na | 2.06 | 0.1 | 4.5 | 101 |
| 2.47% malic acid | 368 | 0 | 39.75 | 315 | na | 1.78 | 0.12 | 4.5 | 116 |
| 2.47% malic acid | 368 | 0.75 | 107.7 | 800 | na | 2.28 | 0.18 | 3.02 | 122 |
| 2.34 wt % citric acid | 365 | 0 | 40.17 | 315 | na | 1.58 | 0.14 | 3.578 | 107 |
| 2.34 wt % citric acid | 365 | 0.75 | 90.23 | 620 | na | 1.75 | 0.11 | 4.5 | 105 |
| 1.64 wt % oxalic acid | 364 | 0 | 25.4 | 200 | na | 1.69 | 0.12 | 4.5 | 115 |
| 1.64 wt % oxalic acid | 364 | 0.75 | 88.5 | 620 | na | 2.14 | 0.16 | 3.648 | 131 |
| 2.15 wt % succinic acid | 364 | 0 | 38.9 | 325 | na | 1.76 | 0.11 | 4.5 | 102 |
| 2.15 wt % succinic acid | 364 | 0.75 | 91.1 | 620 | na | 1.73 | 0.11 | 4.5 | 112 |
| 2.65% 1,3,6-tricarboxyhexane | 364 | 0 | 21.4 | 200 | na | 1.754 | 0.078 | 4.5 | 76 |
| 2.65% 1,3,6-tricarboxyhexane | 364 | 0.75 | 168.2 | >800 | na | 1.744 | 0.09 | 4.15 | 81 |
| 2.13% 1,2,3,4-butanetetracarboxylic | 364 | 0 | 103.15 | 800 | na | 1.99 | | | |
| 2.13% 1,2,3,4-butanetetracarboxylic | 364 | 0.75 | 117.78 | 800 | na | 1.86 | | | |
| 2.14% 1,2,3,4-butanetetracarboxylic | 364 | 0 | 81.5 | 620 | na | 1.9 | 0.2 | 3.097 | 127 |
| 0.43% 1,2,3,4-butanetetracarboxylic | 73 | 0 | 16.2 | 160 | na | 2.18 | 0.02 | 4.5 | 15 |
| 0.43% 1,2,3,4-butanetetracarboxylic | 73 | 0.28 | 22.3 | 200 | na | 1.85 | 0.17 | 3.54 | 132 |
| 7.58 wt % lysine borate | 364 | 0 | 28.03 | 200 | na | 1.39 | 0.09 | 4.5 | 84 |
| 7.58 wt % lysine borate | 364 | 0.75 | 60.28 | 400 | na | 1.42 | 0.09 | 4.5 | 92 |
| 2.625% polyacrylic acid | 364 | 0 | 86.21 | 620 | na | 1.76 | | | |
| 2.625% polyacrylic acid | 364 | 0.75 | 123.52 | 800 | na | 1.73 | | | |
| sodium NTA, 3.35% | 388 | 0 | 28.9 | 250 | na | 1.94 | | | |
| sodium NTA, 3.35% | 388 | 0.75 | 53.6 | 400 | na | 1.59 | | | |
| 3.28% 2-phosphono-1,2,4-butanetricarboxylic acid | 365 | 0 | 83.5 | 620 | na | 1.75 | 0.13 | 4.176 | 78 |
| 3.28% 2-phosphon-1,2,4-butanetricarboxylic acid | 365 | 0.75 | 112.1 | 800 | na | 1.87 | 0.11 | 3.72 | 90 |
| 0.66% 2-phosphon-1,2,4-butanetricarboxylic acid | 73 | 0 | 16.67 | 126 | na | 2.3 | 0.38 | 1.045 | 103 |
| 0.66% 2-phosphon-1,2,4-butanetricarboxylic acid | 73 | 0.75 | 72.28 | 500 | na | 1.58 | 0.16 | 2.762 | 97 |
| 4.79% 6-aminocaproic acid | 365 | 0 | 13.9 | 126 | na | 1.99 | 0.09 | 4.5 | 89 |
| 4.79% 6-aminocaproic acid | 365 | 0.75 | 57.5 | 400 | na | 1.62 | 0.09 | 4.5 | 86 |
| 2.43% aspartic acid | 365 | 0 | 23.6 | 200 | na | 1.85 | | | |
| 2.43% aspartic acid | 365 | 0.05 | 28.6 | 250 | na | 1.99 | | | |
| 2.43% aspartic acid | 365 | 0.75 | 82.8 | 620 | na | 2 | | | |
| 2.43% aspartic acid | 365 | 1.5 | 109.2 | 800 | na | 1.93 | | | |
| 4.86% aspartic acid | 730 | 0 | 30.2 | 250 | na | 1.93 | 0.15 | 2.821 | 99 |
| 4.85% aspartic acid | 730 | 0.75 | 67.4 | 500 | na | 1.8 | 0.14 | 3.666 | 103 |
| 7.29% L-aspartic acid | | 0 | 29.6 | 250 | na | 1.99 | 0.16 | 2.426 | 86 |
| 9.72% L-aspartic acid | | 0 | 34.5 | 315 | na | 2.57 | 0.17 | 2.643 | 93 |
| 2.68% L-glutamic acid | 364 | 0 | 30.96 | 250 | na | 1.95 | 0.16 | 1.949 | 71 |
| 2.68% L-glutamic acid | 364 | 0.75 | 118.46 | 800 | na | 1.83 | 0.13 | 3.521 | 96 |
| 6.55% N-cocoylglutamate | | 0 | 27.07 | 126 | 40 | 1.31 | 0.12 | 2.8 | 55 |
| 6.55% N-cocoylglutamate | | 0.754 | 107.66 | 620 | na | 1.68 | 0.08 | 4.428 | 58 |
| 5.66% histidine | 365 | 0 | 23.63 | 200 | na | 2.23 | 0.1 | 4.5 | 94 |
| 5.66% histidine | 365 | 0.75 | 67.92 | 500 | na | 1.77 | 0.11 | 4.5 | 106 |
| 5.76% arginine | 331 | 0 | 16.9 | 160 | na | 2.28 | 0.1 | 3.2 | 72 |
| 5.76% arginine | 331 | 0.75 | 98.7 | 620 | na | 1.67 | 0.105 | 3.55 | 83 |
| 6.15% ornithine hydrochloride | 365 | 0 | 24.7 | 200 | na | 1.49 | 0.09 | 3.727 | 96 |
| 6.15% ornithine hydrochloride | 365 | 0.75 | 91.8 | 620 | na | 1.81 | 0.08 | 3.927 | 92 |
| 6.03% phenylalanine | 365 | 0 | 17.8 | 126 | na | 1.79 | 0.07 | 4.5 | 65 |
| 6.03% phenylalanine | 365 | 0.75 | 31.31 | 200 | na | 1.23 | 0.07 | 3.75 | 62 |
| 4.81% L-asparagine | 364 | 0 | 24.11 | 200 | na | 2.01 | | | |
| 4.81% L-asparagine | 364 | 0.75 | 112.64 | 800 | na | 1.88 | | | |
| 5.33 wt % L-glutamine | 364 | 0 | 24.2 | 200 | na | 2.1 | 0.15 | 2.207 | 78 |
| 5.33 wt % L-glutamine | 364 | 0.75 | 96.2 | 620 | na | 1.7 | 0.11 | 4.5 | 104 |
| 3.838 wt % DL-serine | 365 | 0 | 22.7 | 200 | na | 2.13 | 0.15 | 2.557 | 95 |
| 3.838 wt % DL-serine | 365 | 0.75 | 65.9 | 500 | na | 1.78 | 0.1 | 4.5 | 93 |
| 2.68% glycine | 357 | 0 | 17.5 | 200 | na | 2.6 | 0.27 | 0.3 | 27 |
| 2.74% glycine | 365 | 0.75 | 113.4 | 800 | na | 1.89 | 0.091 | 4.5 | 88 |

TABLE I-continued

Four-ball extreme pressure and pin and vee block evaluation of several classes of compounds in water.

| | | | ***ASTM D2783 4-ball Extreme Pressure Test**** | | | | ASTM 3233 Extreme Pressure ****Pin & Vee Block Test** | | |
|---|---|---|---|---|---|---|---|---|---|
| Compound | Compound meq./L | $K_2HPO_4$ as wt % $PO_4$ | Load Wear Index Kg | Welding[1] Load Kg | Last Non-seizure Load Kg | Scar diameter for last load before weld mm | Coefficient of friction | Max load[2] K lbs | torque inch-lbs |
| 5.51% polyglutamic acid, sodium | 363 | 0 | | 315 | na | 1.5 | | | |
| 5.51% polyglutamic acid, sodium | 363 | 0.75 | 98.07 | 620 | na | 1.5 | | | |
| 6.15% potassium polyaspartate | 401 | 0 | 34 | 250 | na | 1.51 | | | |
| 1% sodium polyaspartate | 73 | 0.15 | 22.06 | 200 | na | 2.22 | 0.11 | 3.161 | 89 |
| 2.5% sodium polyaspartate | 182 | 0 | 22.94 | 200 | na | 1.87 | | | |
| 2.5% sodium polyaspartate | 182 | 0.375 | 55.2 | 400 | na | 1.72 | 0.1 | 3.693 | 91 |
| 2.5% sodium polyaspartate | 182 | 0.75 | 77.03 | 500 | na | 1.48 | | | |
| 2.5% sodium polyaspartate | 182 | 1.5 | 87.93 | 500 | na | 1.32 | | | |
| 5% sodium polyaspartate | 365 | 0 | 31.7 | 250 | na | 1.69 | | | |
| 5% sodium polyaspartate | 365 | 0 | 41 | 315 | na | 1.68 | | | |
| 5% sodium polyaspartate | 365 | 0 | 39.03 | 315 | na | 1.77 | 0.09 | 3.864 | 74 |
| 5% sodium polyaspartate | 365 | 0.75 | 98.85 | 620 | na | 1.65 | 0.1 | 4.044 | 82 |
| 5% sodium polyaspartate | 365 | 0.75 | 122.29 | 800 | na | 1.73 | 0.11 | 3.743 | 93 |
| 5% sodium polyaspartate | 365 | 0.75 | 119.2 | 800 | na | 1.79 | | | |
| 10% sodium polyaspartate | 730 | 1.5 | 135.86 | 800 | na | 1.6 | 0.08 | 4.125 | 70 |
| polyasparagine, 4.16% | 364 | 0 | 30.1 | 250 | na | 1.54 | | | |
| polyasparagine, 4.16% | 364 | 0.75 | 97.2 | 620 | na | 1.58 | | | |
| 5.59% potassium polyaspartate | 365 | 0 | 50.9 | 400 | na | 1.79 | | | |
| 5.59% potassium polyaspartate | 365 | 0 | 52.22 | 400 | na | 1.86 | 0.19 | 2.434 | 73 |
| 5.59% potassium polyaspartate | 365 | 0.05 | 55.4 | 400 | na | 1.59 | | | |
| 5.59% potassium polyaspartate | 365 | 0.75 | 124.1 | 800 | na | 1.75 | | | |
| 5.59% potassium polyaspartate | 365 | 0.75 | 128.72 | 800 | na | 1.77 | 0.1 | 3.831 | 89 |
| 5.59% potassium polyaspartate | 365 | 1.5 | | >800 | na | 1.94 | 0.12 | 3.443 | 89 |
| 5.59% potassium polyaspartate + 1.86% 1-hydroxyethylidene-1,1-diphosphonic acid (HEDP) | 365 | 90 mM HEDP | 91.2 | 620 | na | 2.03 | | | |
| 4.17% Bovine serum albumin | 365 | 0 | 56.7 | 250 | 100 | 1.15 | 0.24 | 1.092 | 96 |
| 4.17% Bovine serum albumin | 365 | 0.75 | 103.1 | 620 | na | 1.58 | 0.22 | 1.151 | 78 |
| 1% Bovine Serum Albumin | | 0.5 | 81.2 | 500 | na | 1.47 | 0.19 | 2.899 | 116 |
| 4.20% bovine somatotropin | | 0 | 55 | 200 | 126 | 1 | 0.26 | 2.082 | 86 |
| 4.20% bovine somatotropin | | 0.75 | 102.5 | 620 | na | 1.71 | 0.12 | 2.593 | 67 |
| 4.17% Bovine serum albumin | | 0 | 56.7 | 250 | 100 | 1.15 | 0.24 | 1.092 | 96 |
| 4.17% Bovine serum albumin | | 0.75 | 103.1 | 620 | na | 1.58 | 0.22 | 1.151 | 78 |
| urea, 2.19% | 365 | 0 | 13.5 | 126 | na | 2.71 | | | |
| urea, 2.19% | 365 | 0.75 | 68.1 | 500 | na | 1.65 | | | |
| 2.96% urea | 493 | 1.5 | 99.92 | 620 | na | 1.5 | 0.16 | 3.366 | 110 |
| 2.59 wt % polyacrylamide | 364 | 0 | 37.12 | 315 | na | 1.75 | 0.12 | 4.5 | 114 |
| 2.59 wt % polyacrylamide | 364 | 0.75 | 121.75 | 800 | na | 1.81 | 0.1 | 4.5 | 98 |
| 3.62 wt % poly(2-ethyl-2-oxazoline) | 365 | 0 | 24.12 | 126 | na | 1.11 | 0.1 | 4.166 | 71 |
| 3.62 wt % poly(2-ethyl-2-oxazoline) | 365 | 0.75 | 118.52 | 800 | na | 1.81 | 0.09 | 4.5 | 87 |
| 4.27% succinamic acid | 365 | 0 | 22.7 | 200 | na | 2.21 | 0.23 | 1.928 | 81 |
| 4.27% succinamic acid | 365 | 0.75 | 116 | 800 | na | 1.88 | 0.13 | 4.5 | 124 |
| 1.86% biuret | 361 | 0 | 13.33 | 126 | na | 2.47 | | | |
| 1.86% biuret | 361 | 0.75 | 54.65 | 400 | na | 1.64 | | | |
| 3.25 wt % oxamic acid | 365 | 0 | 29.61 | 250 | na | 2 | 0.31 | 1.6 | 76 |
| 3.25 wt % oxamic acid | 365 | 0.75 | 94.67 | 620 | na | 1.81 | 0.19 | 2.531 | 113 |
| 4.2% maleamic acid | 365 | 0 | 30.18 | 250 | na | 1.94 | 0.15 | 3.279 | 97 |
| 4.2% maleamic acid | 365 | 0.75 | 117.53 | 800 | na | 1.84 | 0.19 | 2.546 | 113 |
| 4.71 wt % pyroglutamic acid | 365 | 0 | 24.69 | 200 | na | 1.78 | 0.1 | 4.5 | 98 |
| 4.71 wt % pyroglutamic acid | 365 | 0.75 | 96.3 | 620 | na | 1.63 | 0.11 | 4.5 | 111 |
| L-cystine, 4.37% | 364 | 0 | | >800 | na | 1.94 | 0.1 | 4.082 | 88 |
| L-cystine, 4.38% | 364 | 0.75 | 126.4 | 800 | na | 1.68 | 0.1 | 4.185 | 90 |
| 4.4% L-cysteine | 363 | 0 | 114.37 | 800 | na | 2 | 0.08 | >4.5 | 81 |
| 4.42% L-cysteine | 364 | 0.75 | | >800 | na | 2.34 | 0.09 | 4.314 | 87 |
| 0.0567% L-cysteine | 4.7 | 0 | 15.84 | 126 | na | 2.81 | 0.05 | 1.935 | 14 |
| 0.0567% cysteine | 4.7 | 0.75 | 59.48 | 400 | na | 1.48 | 0.23 | 2.488 | 121 |
| 5.44% methionine | 364 | 0 | 38.06 | 250 | na | 1.33 | 0.09 | 4.232 | 82 |
| 5.44% methionine | 364 | 0.74 | 64.17 | 400 | na | 1.33 | 0.06 | 4.464 | 70 |
| 5.45% penicillamine | 365 | 0 | 84 | 500 | na | 1.49 | 0.077 | 4.5 | 75 |
| 5.45% penicillamine | 365 | 0.75 | 91.4 | 500 | na | 1.31 | 0.077 | 4.5 | 75 |
| 0.545% penicillamine | 36.5 | 0 | 12.6 | 126 | na | 2.4 | 0.248 | 0.3 | 22 |
| 0.545% penicillamine | 36.5 | 0.75 | 12.7 | 126 | na | 1.41 | 0.124 | 4.5 | 120 |
| 4.38% sodium sulfide | 561 | 0 | 108.15 | 800 | na | 1.92 | 0.2 | 2.139 | 94 |
| 4.38% sodium sulfide | 561 | 0.75 | nd | >800 | na | 2 | 0.19 | 2.122 | 92 |
| 6.17% N-phosphonomethylglycine | 365 | 0 | 66.3 | 500 | na | 1.85 | | | |
| 6.17% N-phosphonomethylglycine | 365 | 0.75 | 84.1 | 620 | na | 2 | | | |

TABLE I-continued

Four-ball extreme pressure and pin and vee block evaluation of several classes of compounds in water.

| | | | ***ASTM D2783 4-ball Extreme Pressure Test**** | | | | ASTM 3233 Extreme Pressure ****Pin & Vee Block Test** | | |
|---|---|---|---|---|---|---|---|---|---|
| Compound | Compound meq./L | $K_2HPO_4$ as wt % $PO_4$ | Load Wear Index Kg | Welding[1] Load Kg | Last Non-seizure Load Kg | Scar diameter for last load before weld mm | Coefficient of friction | Max load[2] K lbs | torque inch-lbs |
| 6.17% N-phosphonomethylglycine | 365 | 1.51 | 105.5 | 800 | na | 2.15 | | | |
| 0.81% 1-hydroxyethylidene-1,1-diphosphonic acid | | 0 | 39.1 | 315 | na | 1.79 | 0.13 | 3.541 | 87 |
| 0.81% 1-hydroxyethylidene-1,1-diphosphonic acid + 5.59% potassium polyaspartate | | 0 | 77.2 | 500 | na | 1.63 | 0.09 | 4.089 | 87 |
| 4.13% N,N-di(2-carboxymethyl)-N-methylphosphonic acid | | 0 | 86 | 620 | na | 1.9 | 0.09 | 4.5 | 92 |
| 1.79% N-phosphonomethyl glycine | | 0 | 63.4 | 500 | na | 1.89 | 0.09 | 4.5 | 86 |
| 1.79% N-phosphonomethyl glycine + 5.59% potassium polyaspartate | | 0 | 55.4 | 400 | na | 1.62 | 0.08 | 4.5 | 75 |
| 0.064% sodium pyrophosphate | 2.4 | 0 | 14.63 | 126 | 13 | 2.56 | 0.18 | 0.505 | 25 |
| 1.147% sodium pyrophosphate | 43.1 | 0 | 33.56 | 250 | na | 1.47 | 0.27 | 1.866 | 114 |
| 0.0573% sodium pyrophosphate | 2.15 | 0.75 | 53.57 | 400 | na | 1.62 | 0.16 | 3.317 | 114 |
| 6.26% 1-hydroxyethylidene-1,1-diphosphonic acid | 304 | 0 | | >800 | na | 2.07 | | | |
| 6.26% 1-hydroxyethylidene-1,1-diphosphonic acid | 304 | 0.75 | | >800 | na | 2.02 | | | |
| 6.755 wt % O-phosphoserine | 365 | 0 | 92.6 | 620 | na | 1.69 | 0.08 | 4.5 | 77 |
| 0.676 wt % O-phosphoserine | 36.5 | 0 | 21.2 | 200 | na | 2 | 0.23 | 2.465 | 86 |
| 1.71% glycerol-2-phosphate, Na | 79.2 | 0 | 28.4 | 250 | na | 1.86 | 0.21 | 2.576 | 108 |
| 1.71% glycerol-2-phosphate, Na | 79.2 | 0.75 | 76.35 | 500 | na | 1.68 | 0.17 | 2.708 | 102 |
| 3.28% 1,3-dihydroxyacetone dimer | 182 mM | 0 | 19.53 | 160 | na | 2.47 | | | |
| 3.28% 1,3-dihydroxyacetone dimer | 182 mM | 0.75 | 71.46 | 500 | na | 1.59 | | | |
| 7.2% 2,4,6-trichlorophenol | 364 mM | 0 | 70.33 | 400 | na | 1.46 | 0.1 | 3.826 | 80 |
| 7.13% 2,4,6-trichlorophenol | 361 | 0.75 | 88.97 | 500 | na | 1.4 | 0.17 | 2.291 | 88 |
| 1.26 wt % K2B10O16 · 8H2O | 21.5 mmol/L | 0 | 63.6 | 500 | na | 1.92 | 0.14 | 3.605 | 108 |
| 1.26 wt % K2B10O16 · 8H2O + 5.59 wt % KPA | 21.5/365 | 0 | 90.1 | 620 | na | 2.05 | 0.09 | 45 | 91 |
| 3.63% poly(2-ethyl-2-oxazoline) + 1.26% potassium pentaborate octahydrate | | 0 | 59.4 | 400 | na | 1.48 | 0.08 | 4.5 | 82 |
| 2.68% L-glutamic + 1.26% potassium pentaborate octahydrate | | 0 | 84.5 | 620 | na | 1.93 | 0.1 | 4.5 | 94 |
| 2.43% L-aspartic acid + 1.26% potassium pentaborate octahydrate | | 0 | 83.4 | 620 | na | 1.96 | 0.12 | 3.629 | 94 |
| 2.34% citric acid + 1.26% potassium pentaborate octahydrate | | 0 | 104.5 | 800 | na | 2.36 | 0.11 | 3.564 | 93 |
| 2.47% malic acid + 1.262% potassium pentaborate octahydrate | | 0 | 84.8 | 620 | na | 2 | 0.14 | 3.664 | 109 |
| 2.19% urea + 1.26% potassium pentaborate octahydrate | | 0 | 48.3 | 400 | na | 1.74 | 0.13 | 4.241 | 111 |
| 0.49% boric acid + 5.59% KPA | | 0 | 73.3 | 500 | na | 1.7 | 0.1 | 3.943 | 89 |
| 0.49% boric acid | 792/365 | 0 | 16.9 | 160 | na | 2.04 | 0.07 | 2.577 | 21 |
| 2.79% potassium polyaspartate + 1.22% polyacrylate | 253/111 | 0 | 119 | 800 | na | 1.785 | 0.079 | 3.55 | 62 |
| 2.79% potassium polyaspartate + 1.22% polyacrylate, potassium salt | 253/111 | 0.75 | 149.5 | 800 | na | 1.463 | 0.113 | 2.7 | 70 |
| 2.1% polyacrylate, potassium salt | 191 | 0 | 17 | 160 | na | 1.759 | 0.111 | 3 | 75 |
| 2.1% polyacrylate, potassium salt | 191 | 0.75 | 162.7 | 800 | na | 1.978 | 0.154 | 2.5 | 89 |
| 0.41% polyacrylate, potassium salt | 37 | 0 | 10.1 | 126 | na | 2.894 | fail | fail | fail |
| 0.41% polyacrylate, potassium salt | 37 | 0.75 | 64.4 | 400 | na | 1.22 | 0.224 | 2.1 | 111 |
| 0.41% polyacrylate + 0.56% potassium polyaspartate | 57/36.6 | 0.75 | 85 | 500 | na | 1.365 | 0.192 | 2 | 91 |
| 2.59% polyacrylamide | 364 | 0 | 37.4 | 315 | na | 1.75 | 0.12 | 4.5 | 117 |
| 2.59% polyacrylamide | 364 | 0.75 | 118.4 | 800 | na | 2.13 | 0.11 | 4.162 | 102 |
| 2.79% KPA + 1.3% polyacrylamide | 182/183 | 0 | 53.1 | 400 | na | 1.62 | 0.08 | 4.242 | 82 |
| 2.79% KPA + 1.3% polyacrylamide | 182/183 | 0.75 | 123.4 | 800 | na | 1.75 | 0.1 | 3.974 | 95 |
| 0.52% polyacrylamide | 73 | 0 | 17.8 | 126 | na | 2.3 | 0.03 | 0.84 | 72 |

TABLE I-continued

Four-ball extreme pressure and pin and vee block evaluation of several classes of compounds in water.

| | | | ***ASTM D2783 4-ball Extreme Pressure Test**** | | | | ASTM 3233 Extreme Pressure ****Pin & Vee Block Test** | | |
|---|---|---|---|---|---|---|---|---|---|
| Compound | Compound meq./L | $K_2HPO_4$ as wt % $PO_4$ | Load Wear Index Kg | Welding[1] Load Kg | Last Non-seizure Load Kg | Scar diameter for last load before weld mm | Coefficient of friction | Max load[2] K lbs | torque inch-lbs |
| 0.52% polyacrylamide | 73 | 0.75 | 69.45 | 500 | na | 1.73 | 0.16 | 3.149 | 112 |
| 2.86% polyethyleneimine-80% ethoxylated | | 0 | 21.22 | 160 | na | 1.85 | 0.12 | 2.899 | 71 |
| 2.86% polyethyleneimine-80% ethoxylated | | 0.75 | 76.07 | 500 | na | 1.58 | 0.09 | 4.5 | 84 |
| 4.79% 6-aminocaproic acid | | 0.75 | 57.5 | 400 | na | 1.62 | 0.09 | 4.5 | 86 |
| 5.48 wt % Mercaptosuccinic acid | 365 | 0 | | >800 | na | 1.84 | 0.01 | 4.5 | 93 |
| 5.48 wt % Mercaptosuccinic acid | 365 | 0.75 | | | | | 0.09 | 4.5 | 90 |
| 3.31 wt % Dimercaptosuccinic acid | 365 | 0 | | | | | 0.11 | 4.431 | 118 |
| 3.31 wt % Dimercaptosuccinic acid | 365 | 0.75 | | | | | 0.23 | 2.196 | 116 |
| 3.36 wt % Mercaptoacetic acid | 365 | 0 | | | | | 0.09 | 4.5 | 88 |
| 3.36 wt % Mercaptoacetic acid | 365 | 0.75 | | | | | 0.11 | 3.655 | 89 |
| 3.87 wt % 2-mercaptopropionic acid | 365 | 0 | | | | | 0.1 | 4.172 | 85 |
| 3.87 wt % 2-mercaptopropionic acid | 365 | 0.75 | | | | | 0.1 | 3.215 | 73 |
| 5.85 wt % (alpha) 2-hydroxyOctanoic acid | 365 | 0 | | | | | 0.18 | 1.776 | 43 |
| 5.85 wt % (alpha) 2-hydroxyOctanoic acid | 365 | 0.75 | | | | | 0.16 | 3.528 | 45 |
| 7.894 wt % 12-hydroxyDodecanoic acid | 365 | 0 | | | | | 0.12 | 3.356 | 47 |
| 7.891 wt % 12-hydroxyDodecanoic acid w/0.75% PO4 | 365 | 0.75 | | | | | 0.07 | 3.307 | 56 |
| 3.8% dithiodipropionic acid | 365 | 0 | 98.2 | 620 | na | 1.63 | 0.19 | 2.5 | 111 |
| 3.8% dithiodipropionic acid | 365 | 0.75 | 130.97 | 800 | na | 1.67 | 0.21 | 2.24 | 107 |

na = none achieved
Maximum loads [1]800 Kg [2]4.5 K lbs.
$K_2HPO_4$ = dipotassium orthophosphate
KPA = potassium salt of polyaspartic acid (or potassium polyaspartate)

Example 2

Figure 2:
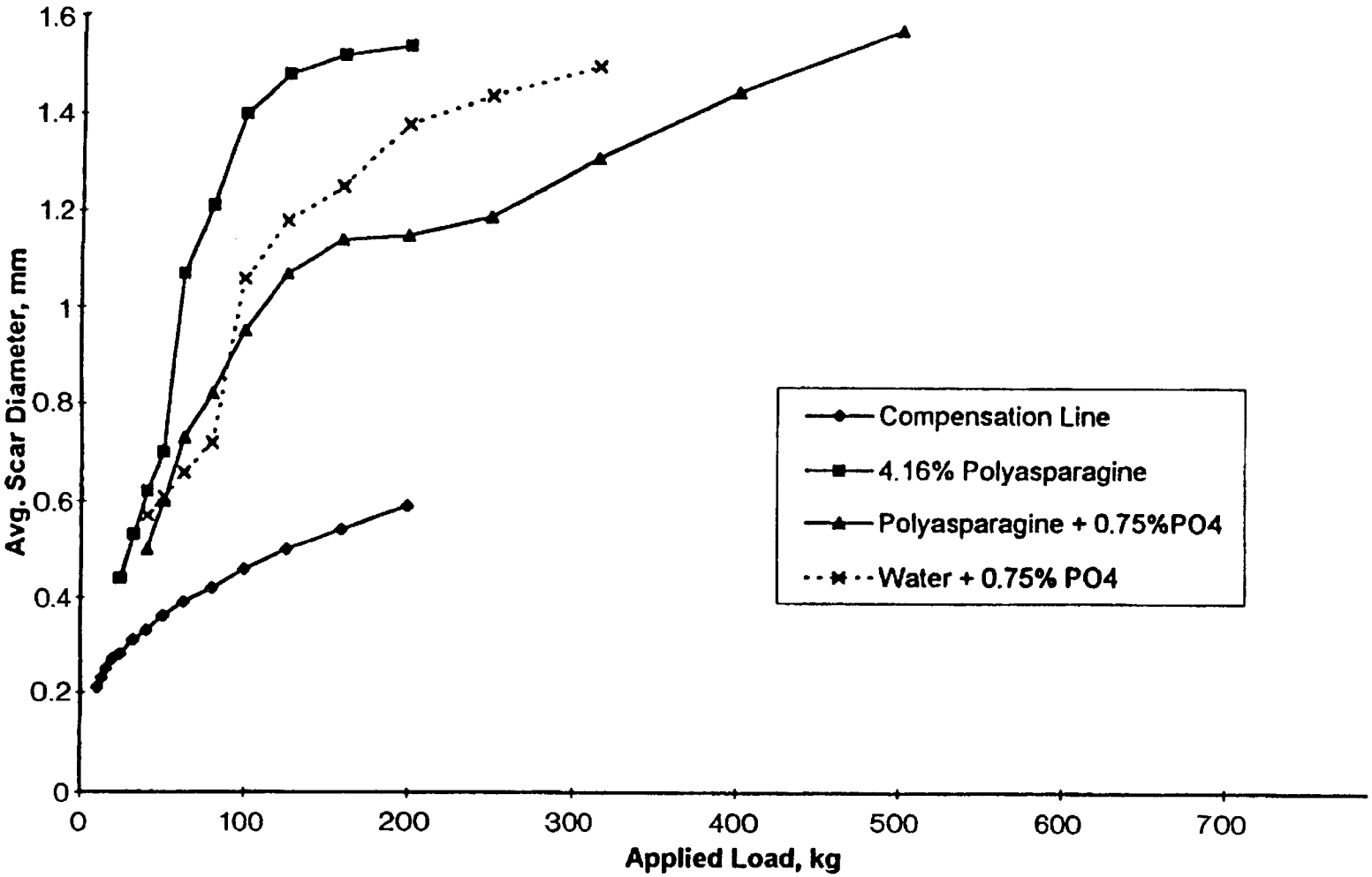
Figure 3:
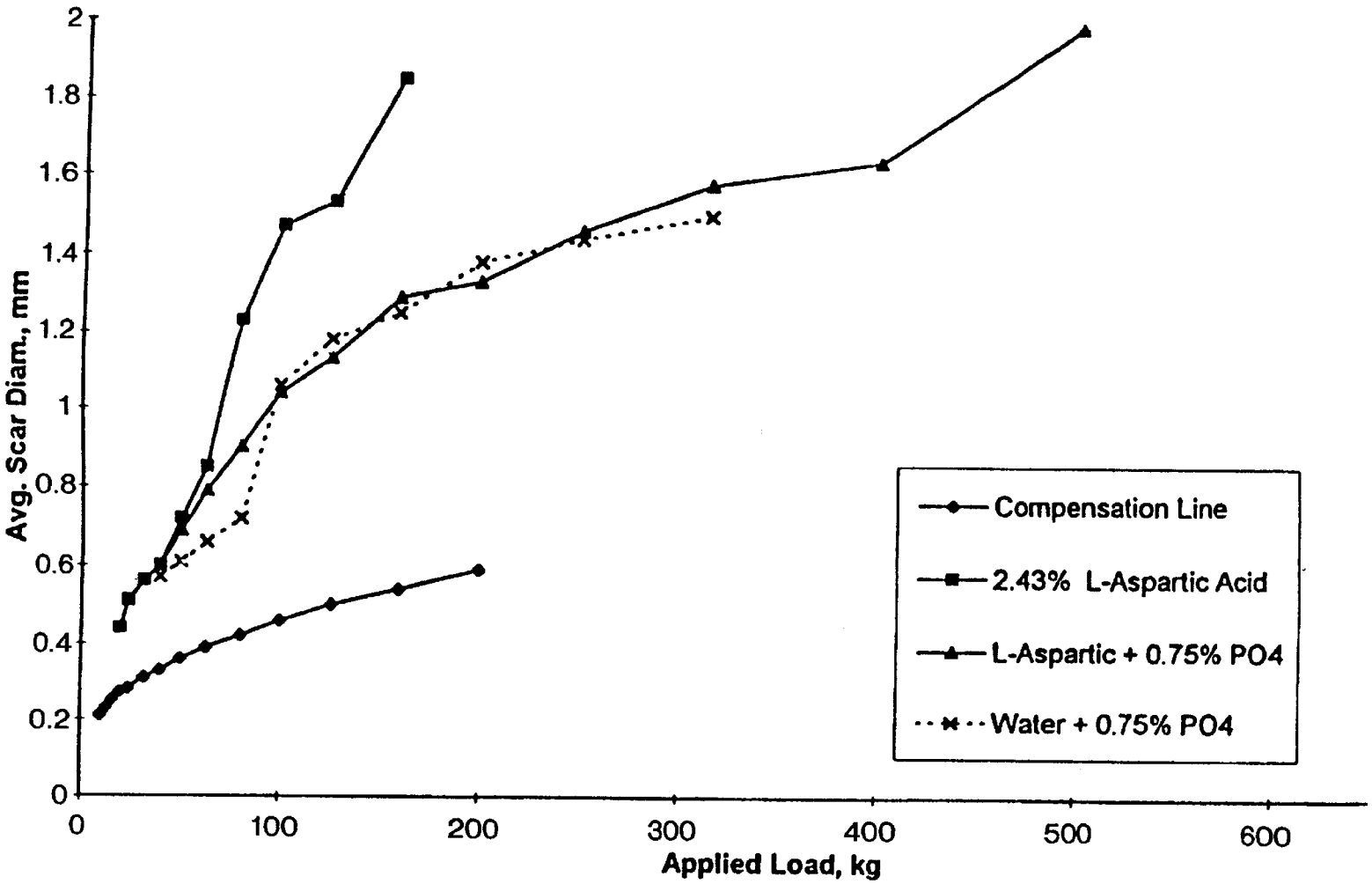
Figure 4:
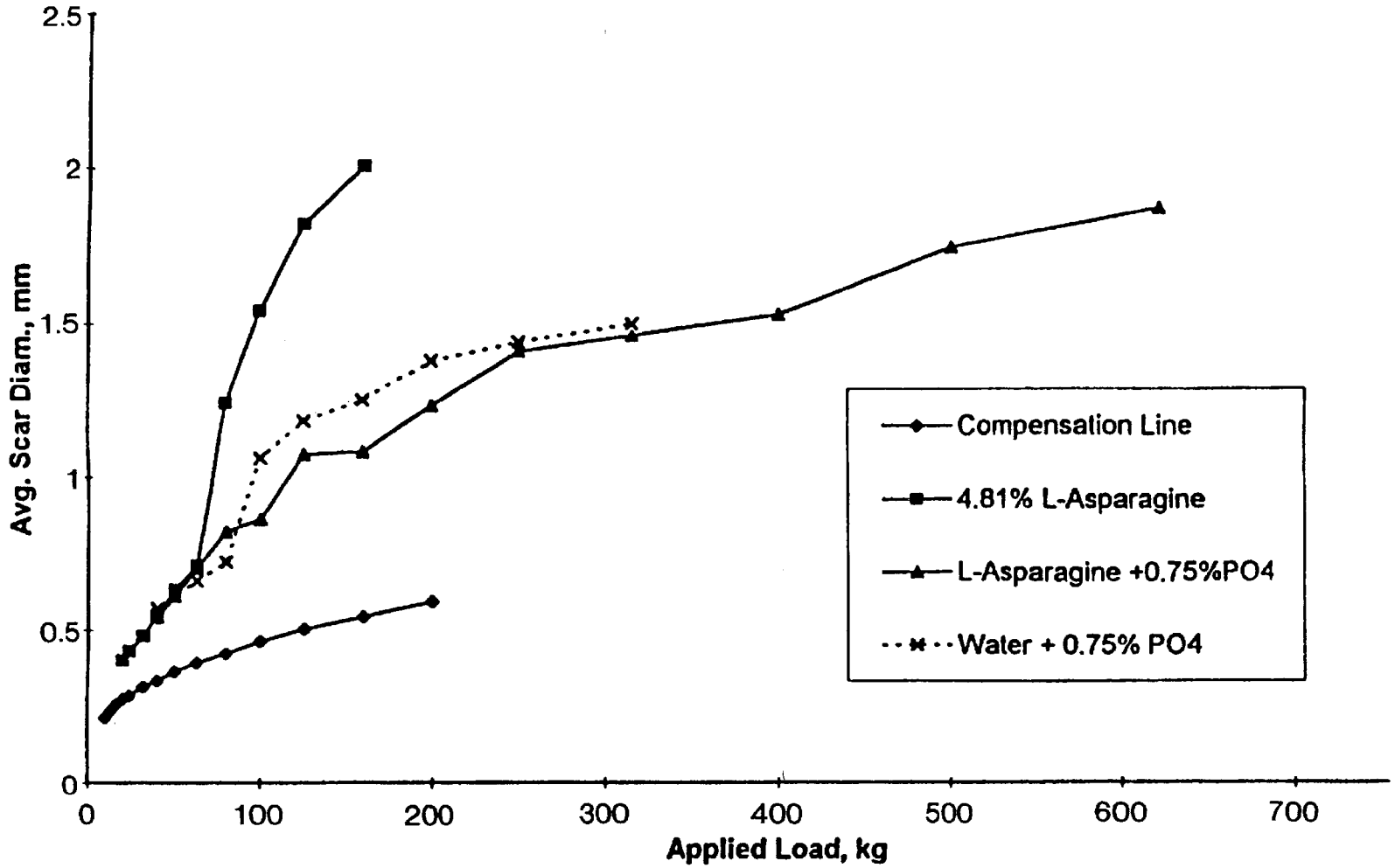
Figure 5:
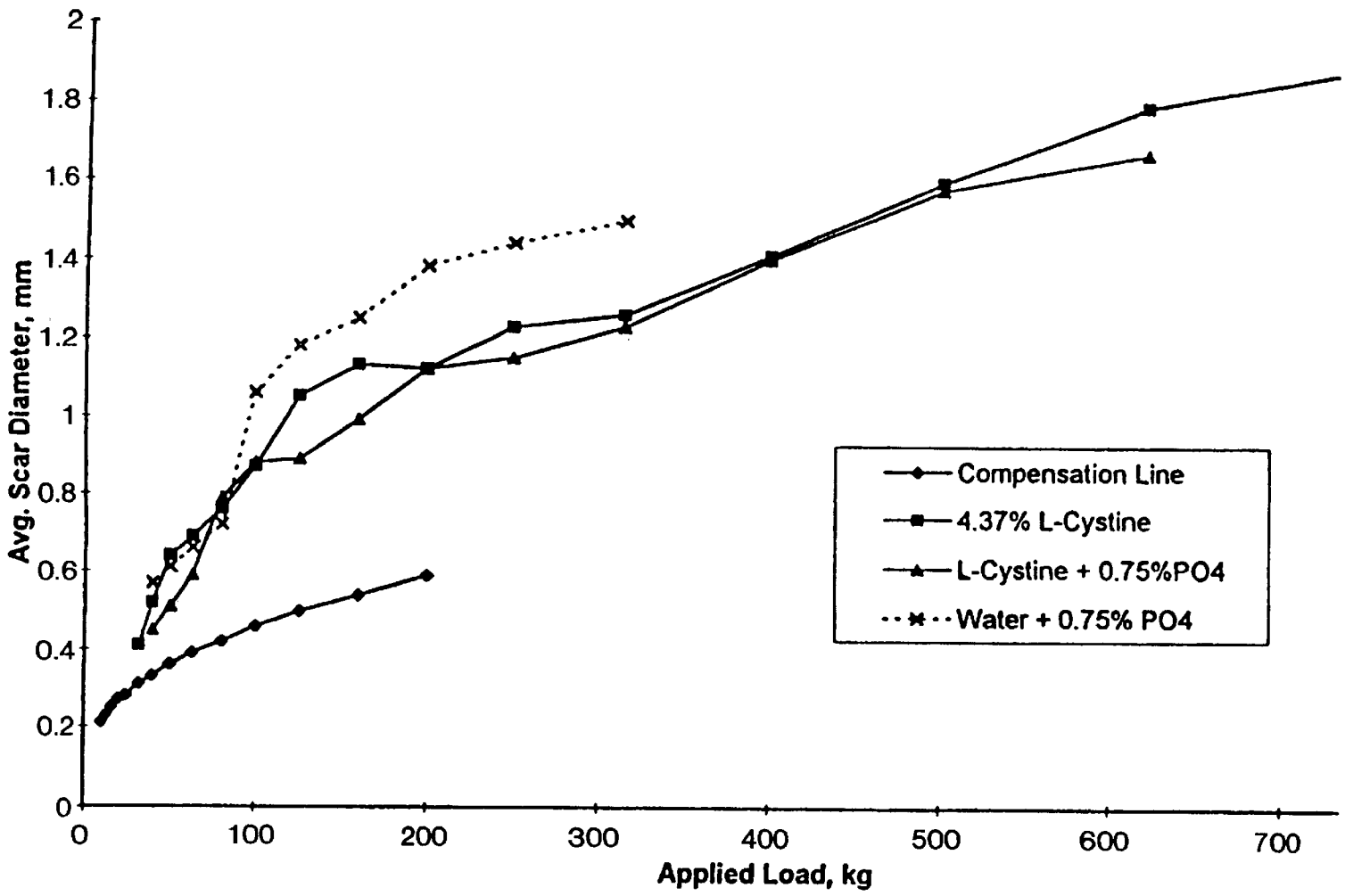
Figure 6:
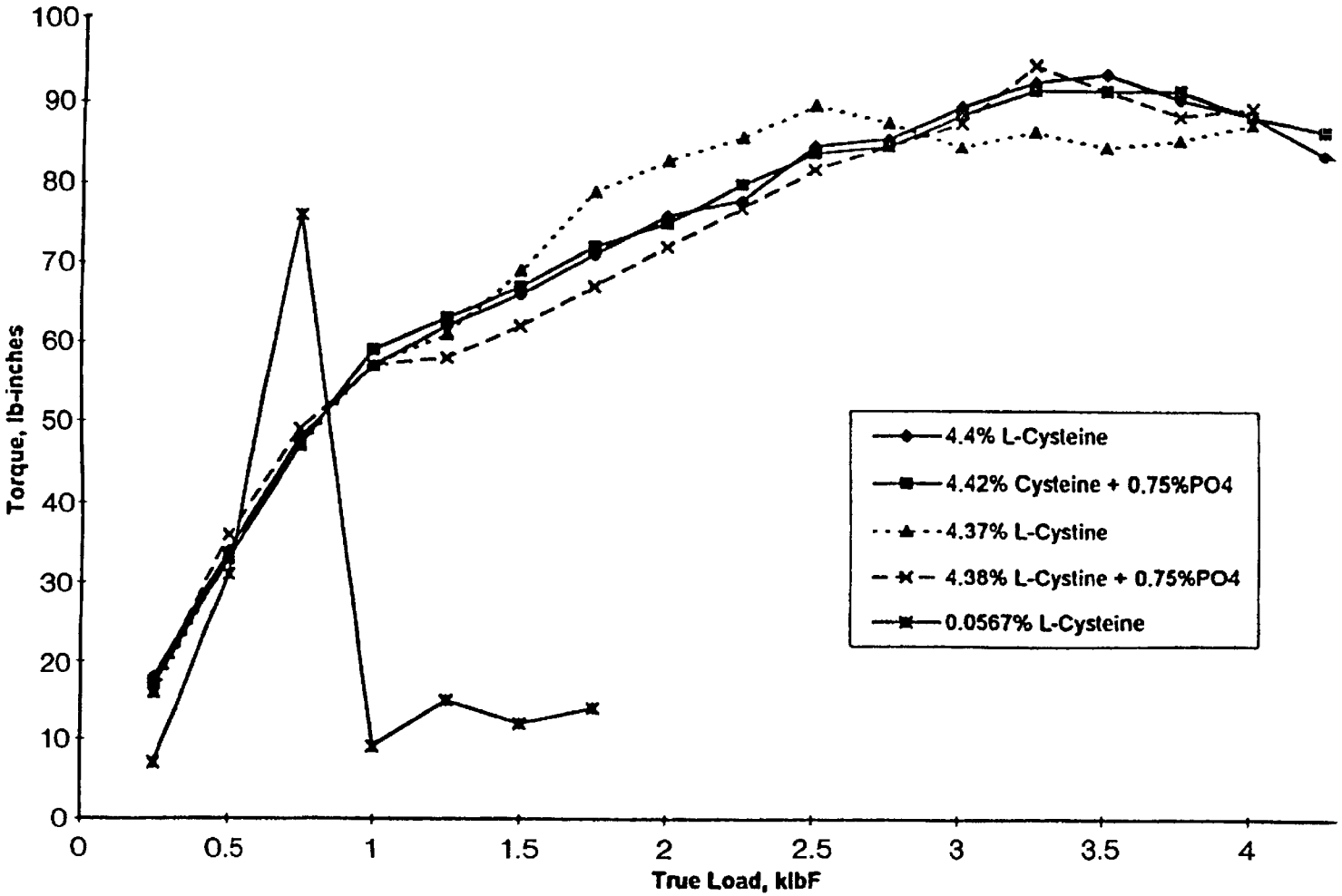
Figure 7:
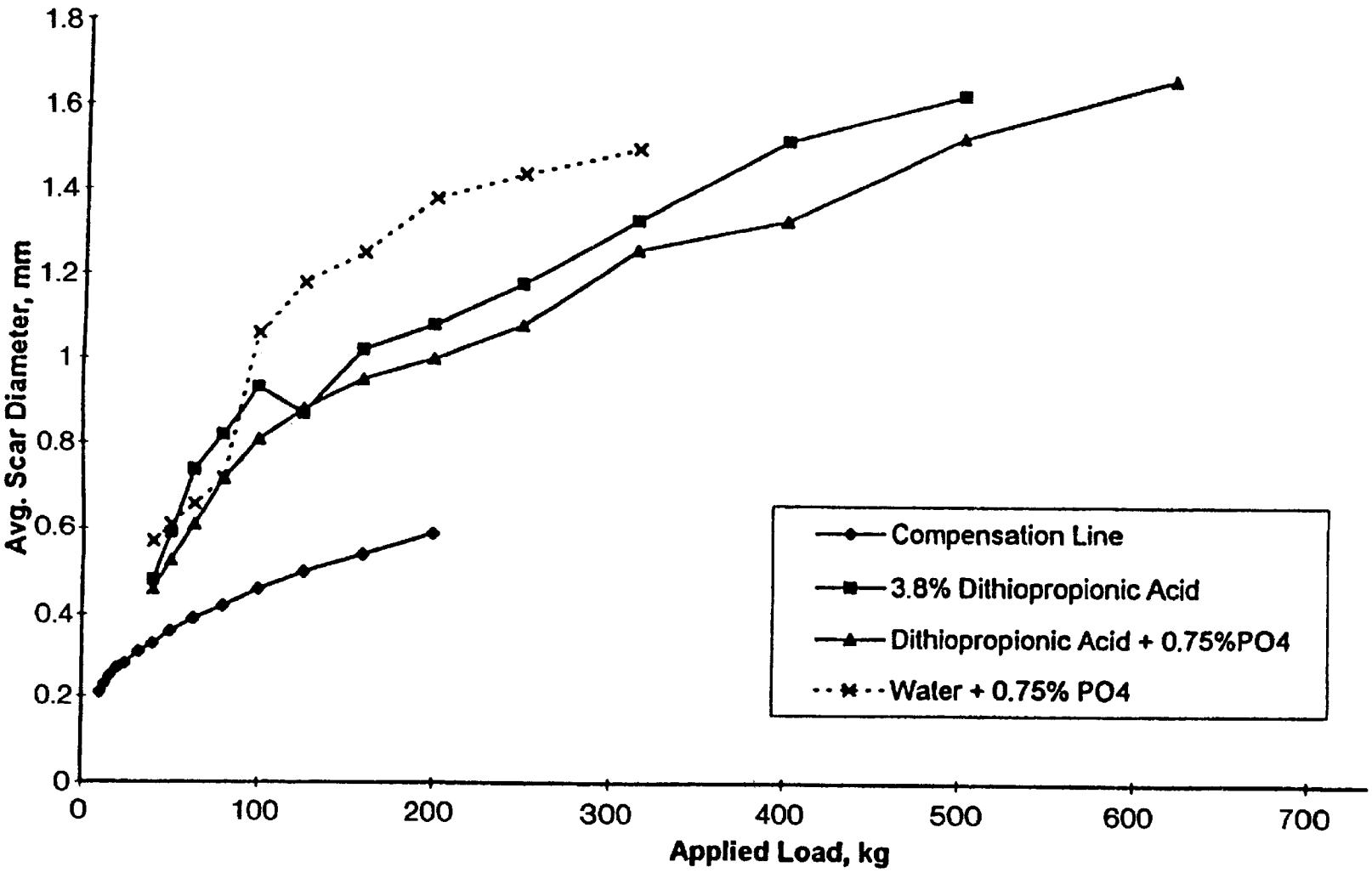
Figure 8:
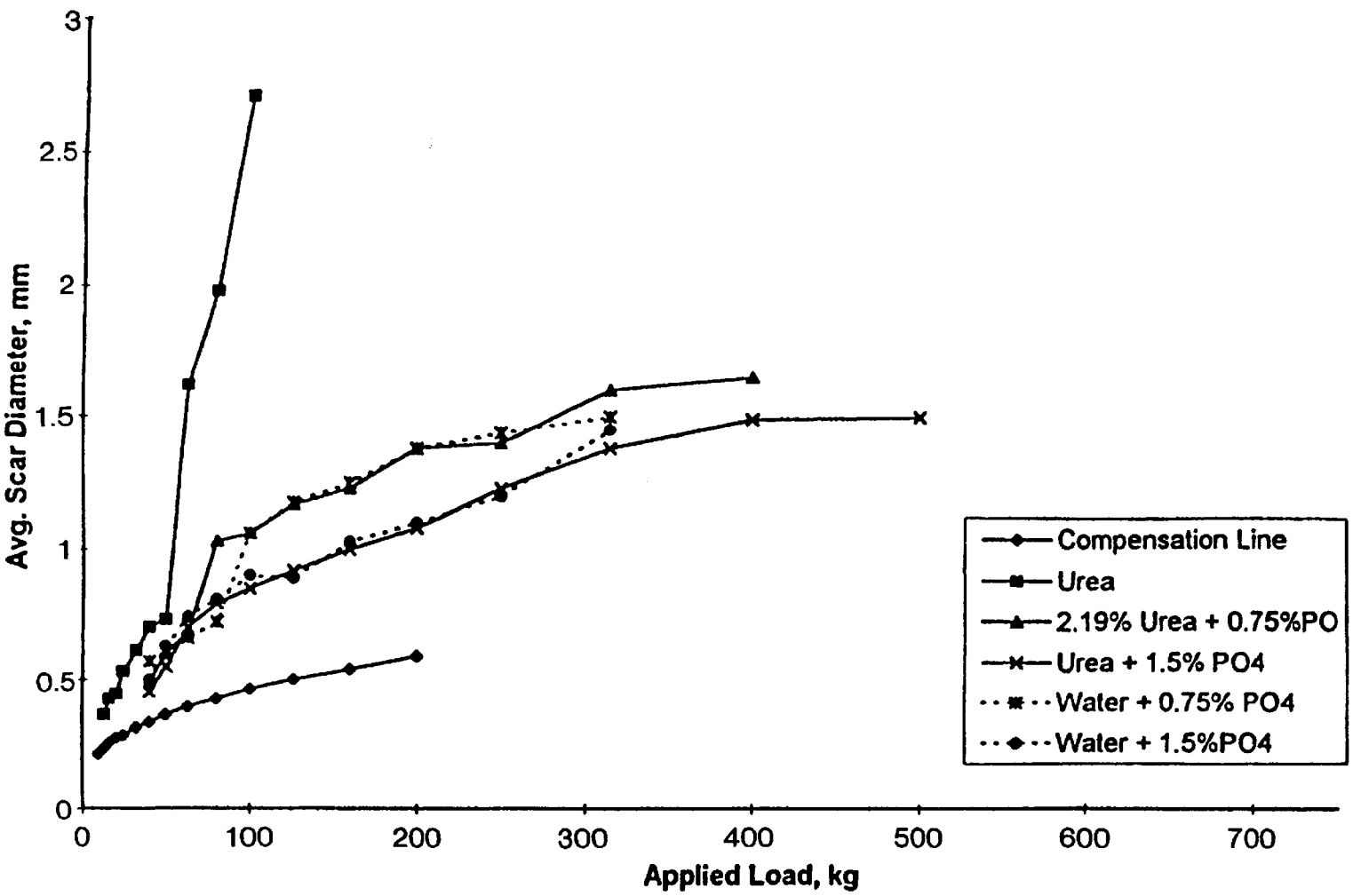
Figure 9:
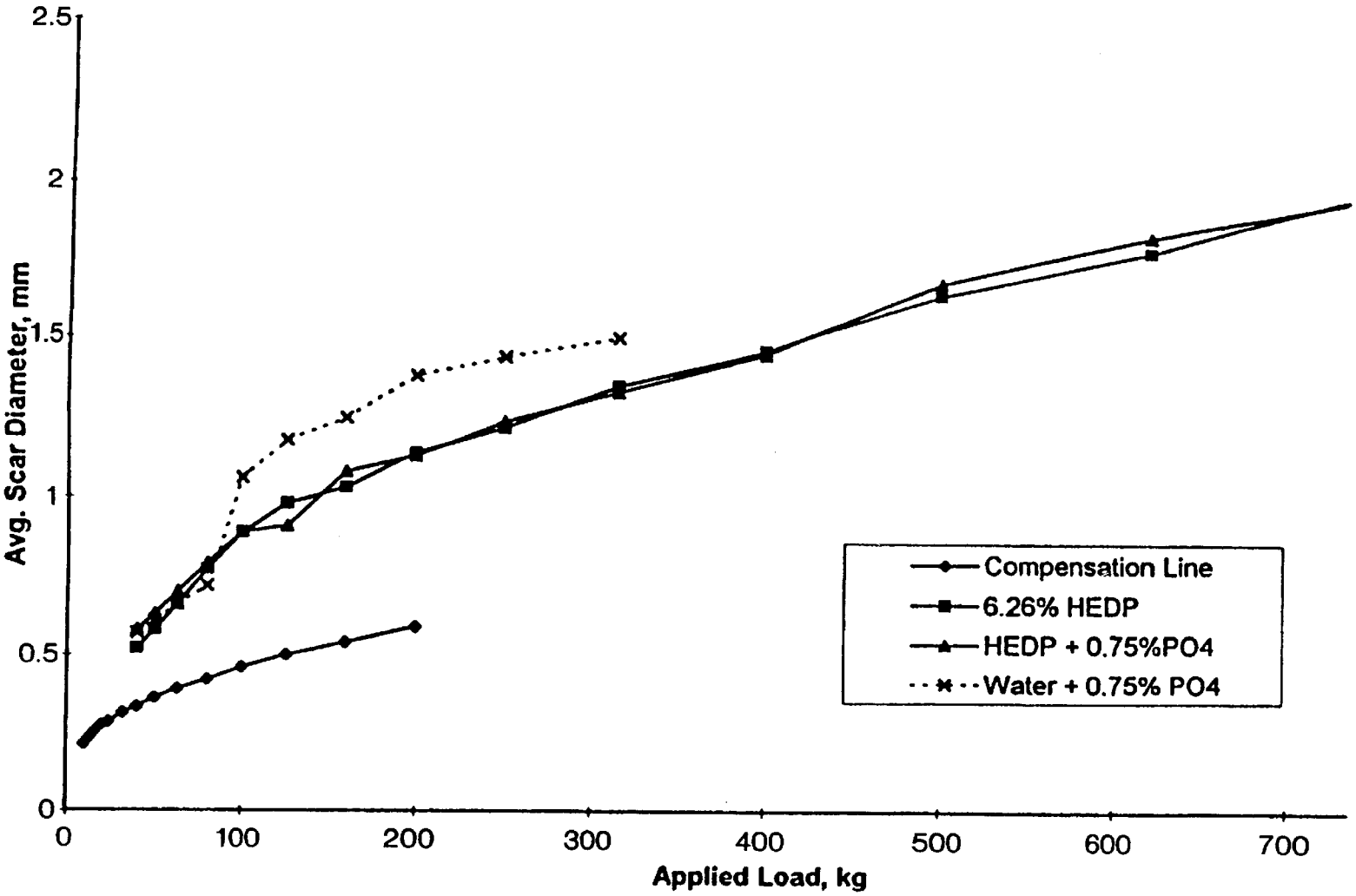
Figure 10:
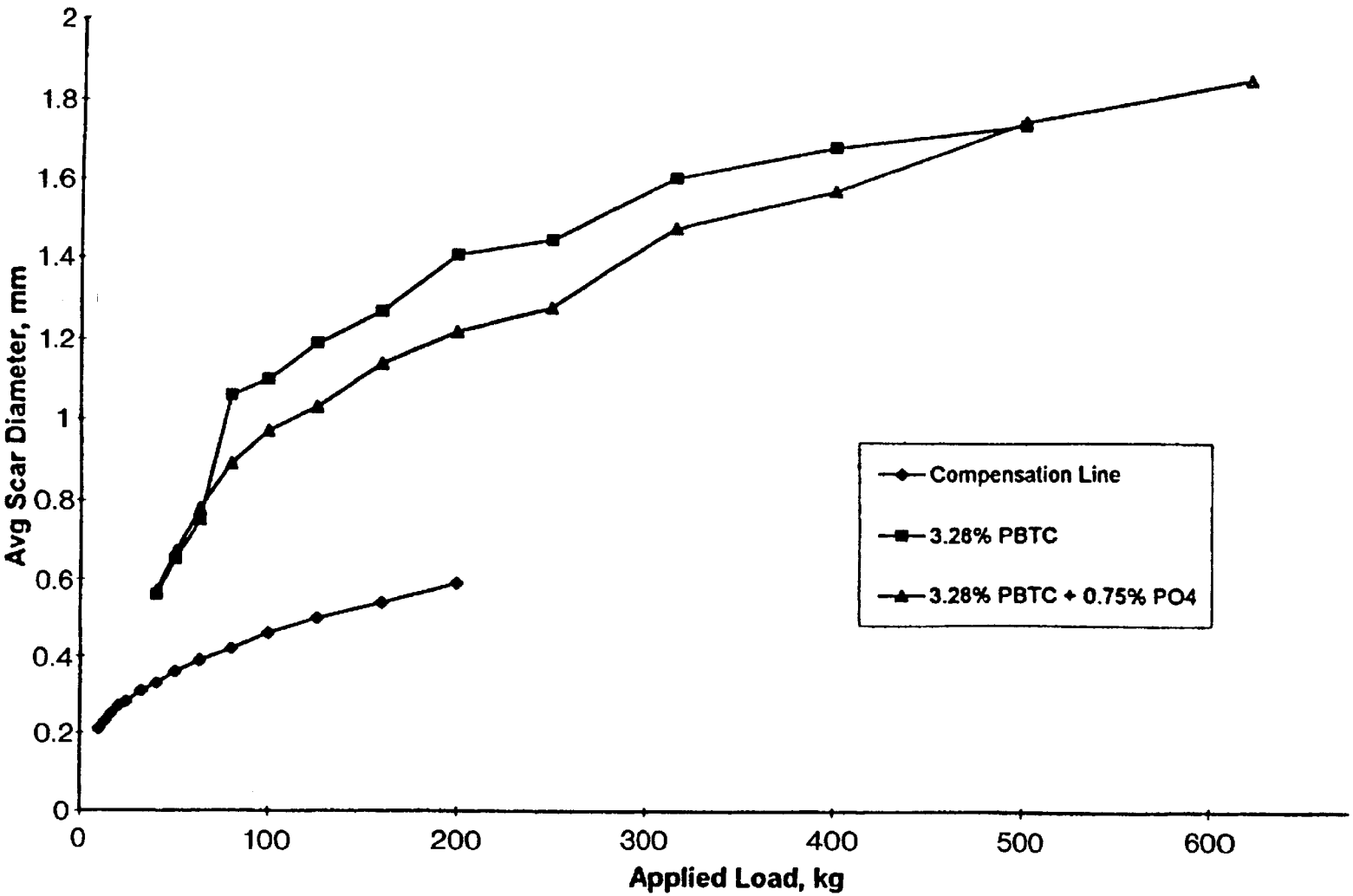
Figure 11:
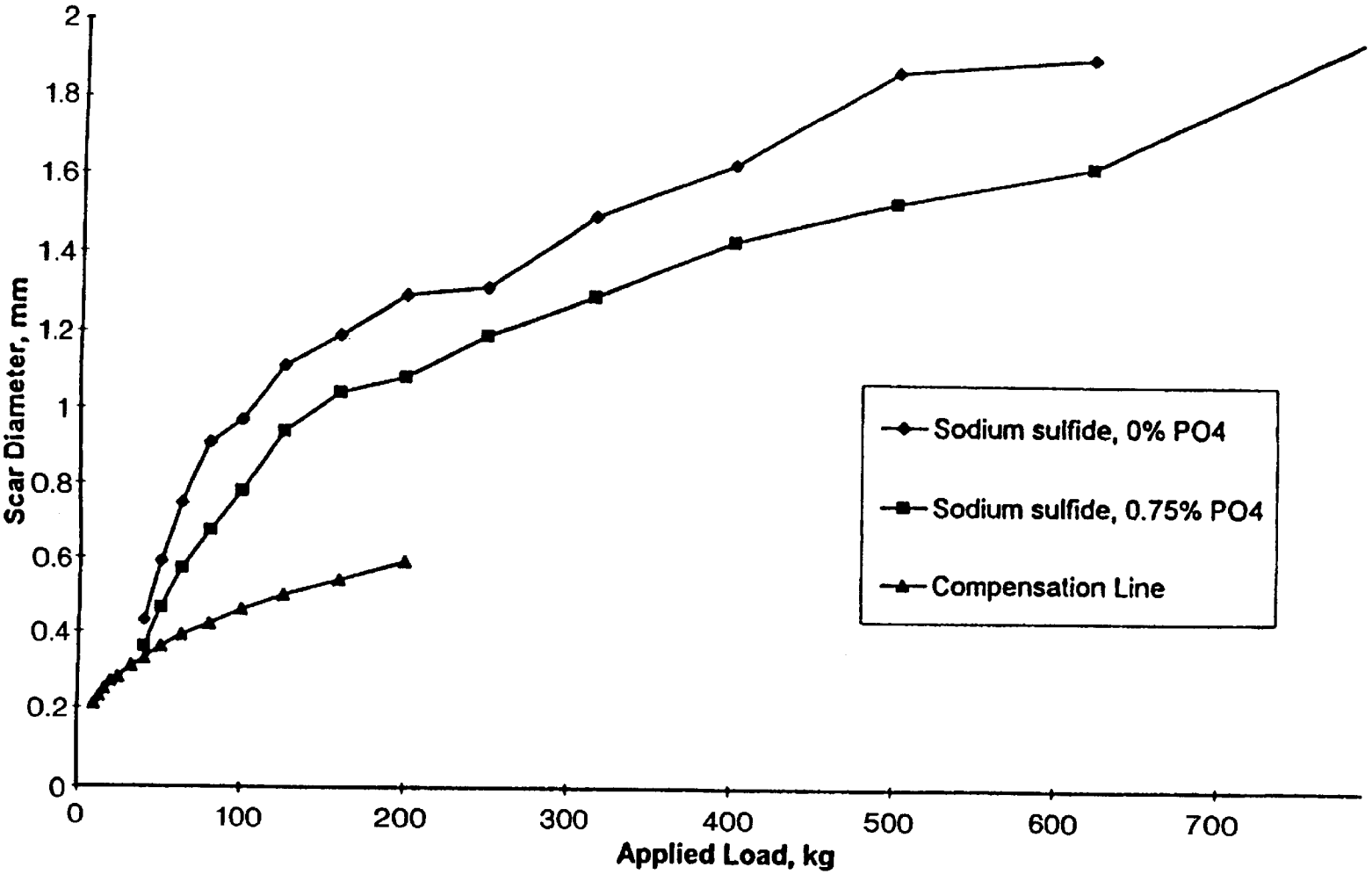
Figure 12:
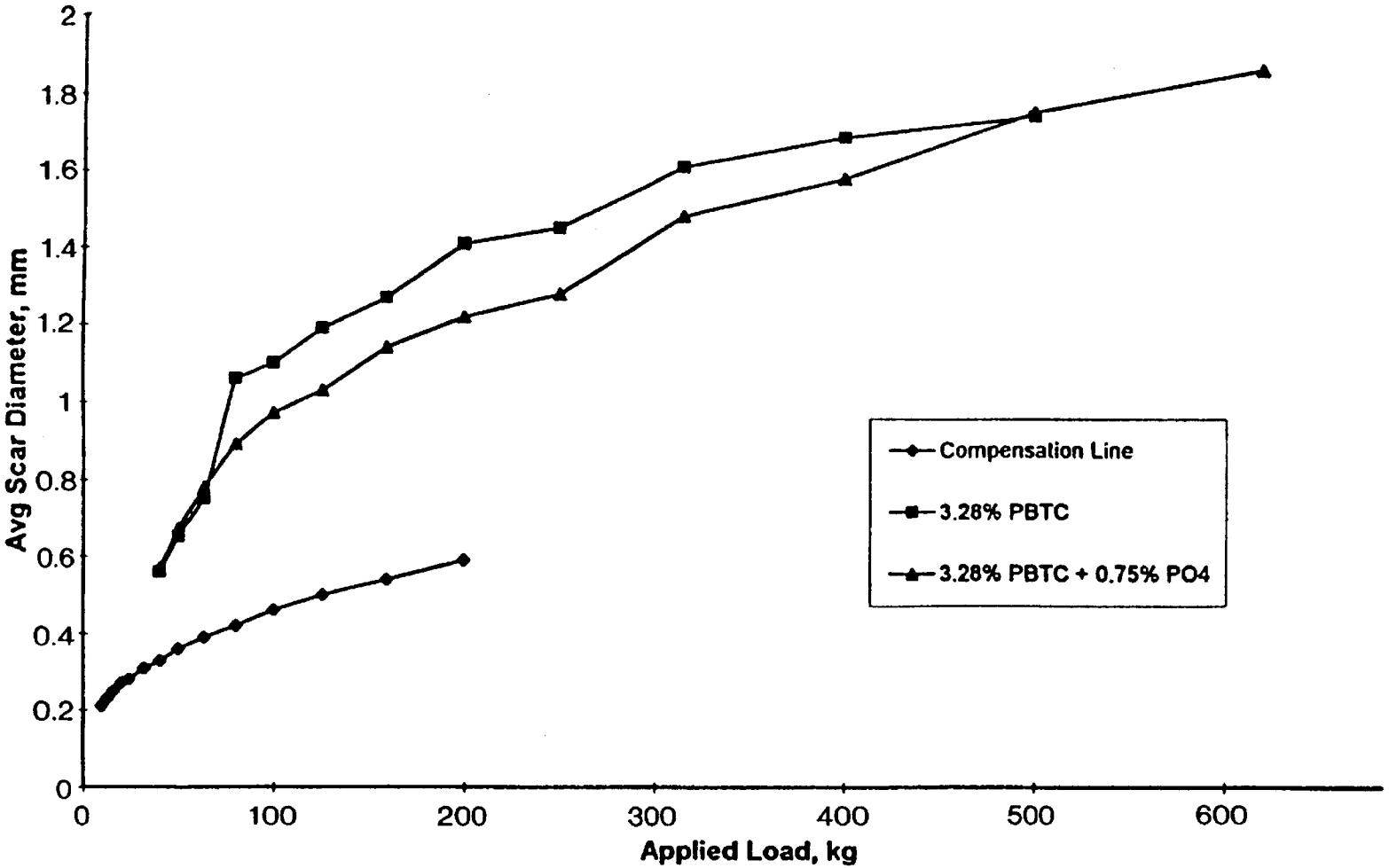
Figure 14:
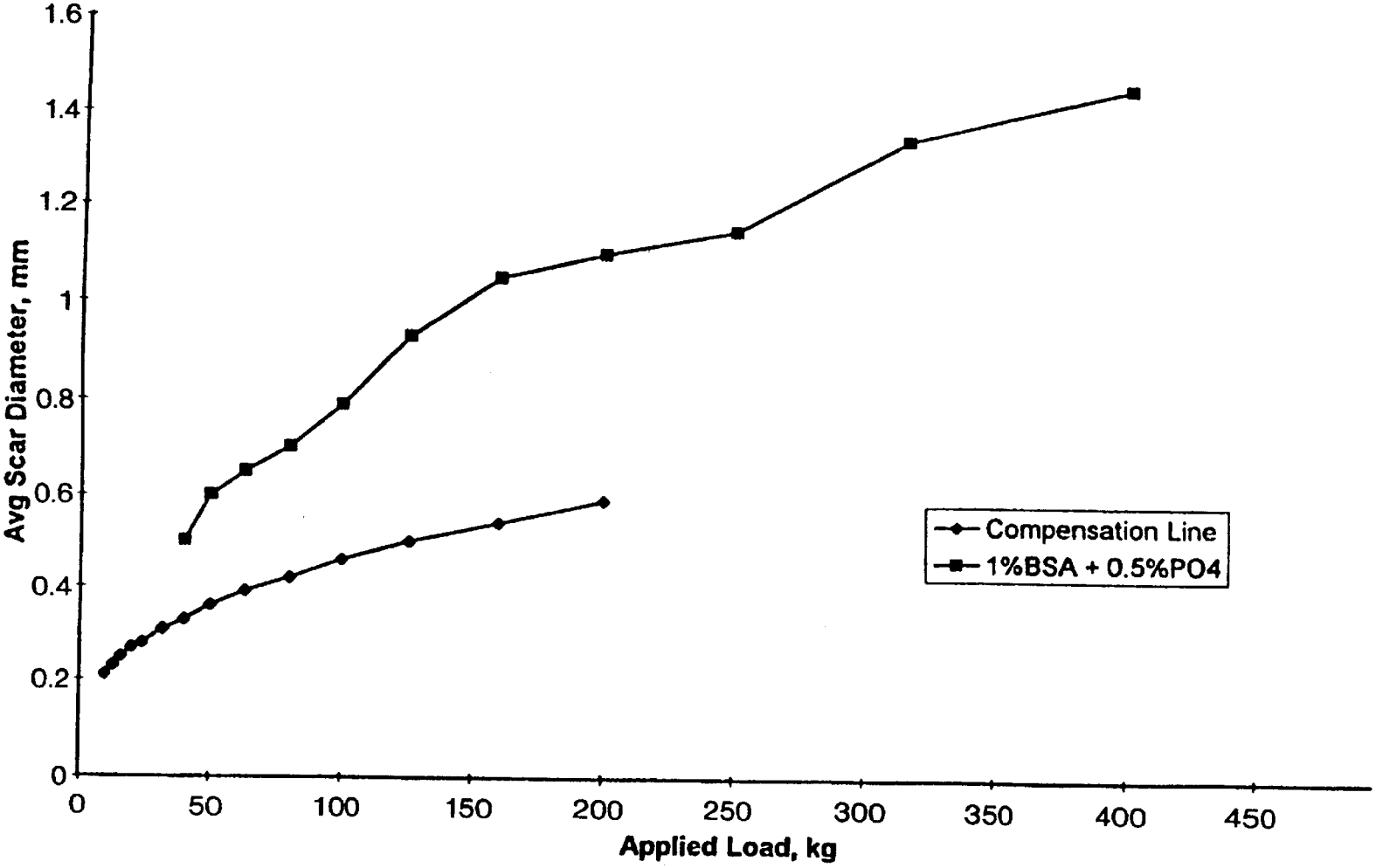

A series of experiments using the procedures of ASTM D2783 and ASTM 3233B were run to measure the extreme-pressure lubricating properties of compositions selected from several classes of compounds. The pH of the solutions were generally adjusted to about 10. The results are depicted in FIGS. 1 through 12. FIG. 1 shows the scar diameter vs applied load for sodium polyglutamate in the presence and the absence of potassium orthophosphate. FIG. 2 shows the scar diameter vs applied load for polyasparagine in the presence and absence of potassium orthophosphate. FIG. 3 shows the scar diameter vs applied load for L-aspartic acid in the presence and absence of potassium orthophosphate. FIG. 4 shows the scar diameter vs applied load for L-asparagine in the presence and absence of potassium orthophosphate. FIG. 5 shows the scar diameter vs applied load for L-cystine in the presence and absence of potassium orthophosphate. FIG. 6 shows the torque vs load for L-cystine and L-cysteine in the presence and absence of potassium orthophosphate. FIG. 7 shows the scar diameter vs applied load for dithiodipropionic acid in the presence and absence of potassium orthophosphate. FIG. 8 shows the scar diameter vs applied load for urea in the presence and absence of potassium orthophosphate. FIG. 9 shows the scar diameter vs applied load for 1-hydroxyethylidene-1, 1-diphosphonic acid in the presence and absence of potassium orthophosphate. FIG. 10 shows the scar diameter vs applied load for 2-phosphono-1,2,4-butanetricarboxylic acid in the presence and absence of potassium orthophosphate. FIG. 11 shows the scar diameter vs applied load for sodium sulfide in the presence and absence of potassium orthophosphate. FIG. 12 shows the scar diameter vs applied load for 2-phosphono-1,2,4-butanetricarboxylic acid (PBTC) in the presence and absence of potassium orthophosphate. FIG. 14 shows the scar diameter vs. applied load for Bovine serum albumin in the presence and absence of orthophosphate.

Figure 15:
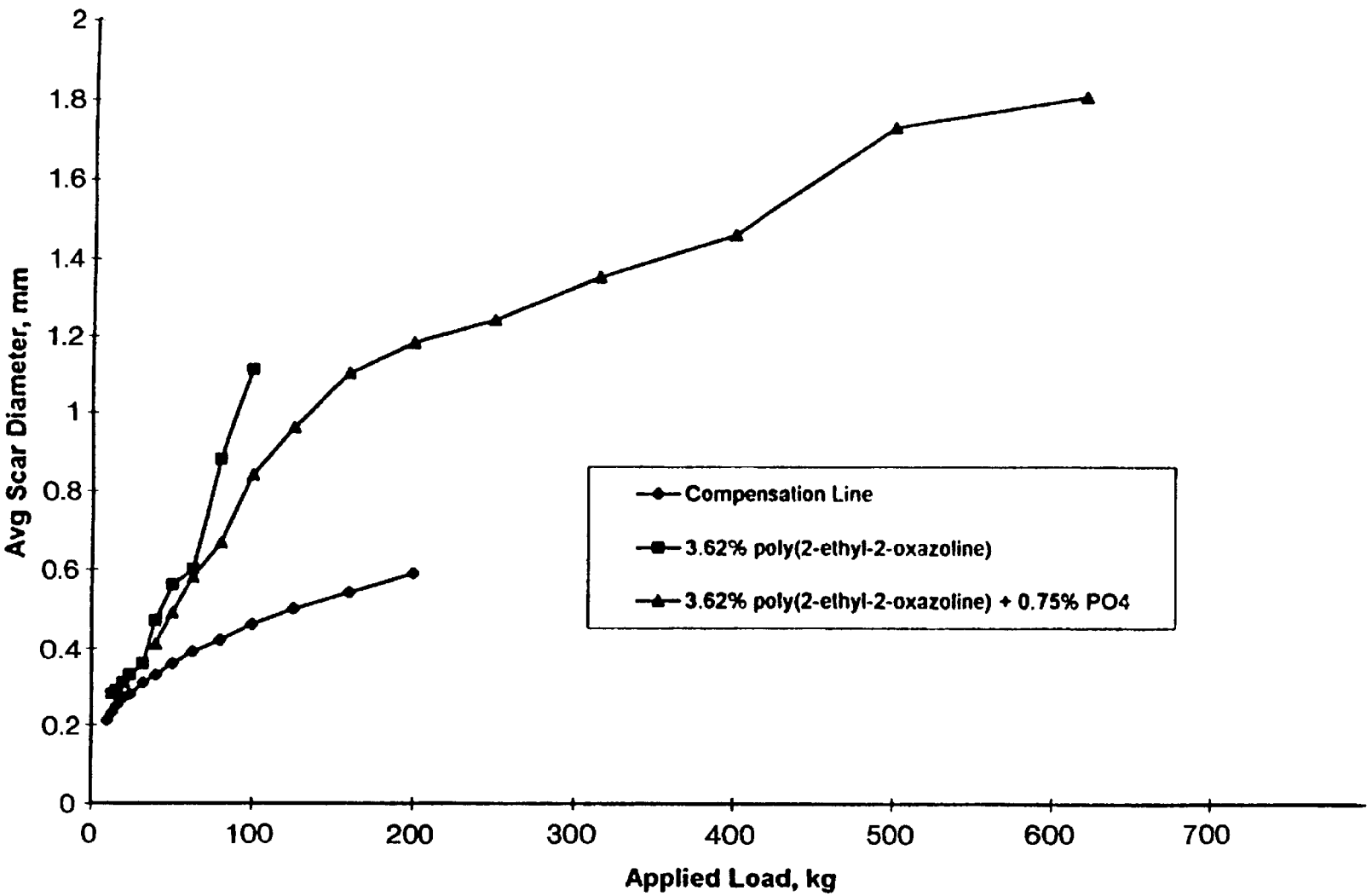
Figure 16:
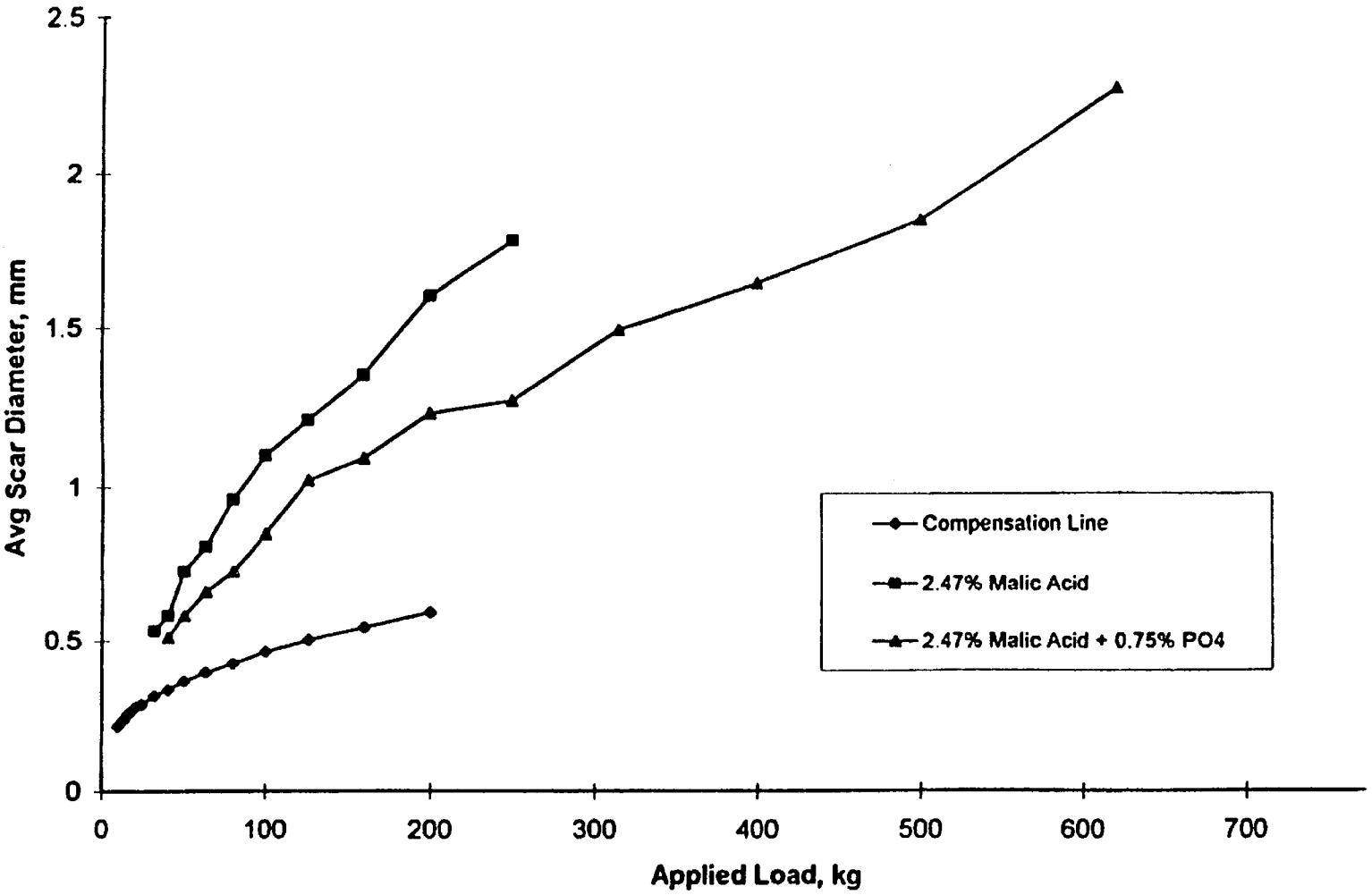
Figure 17:
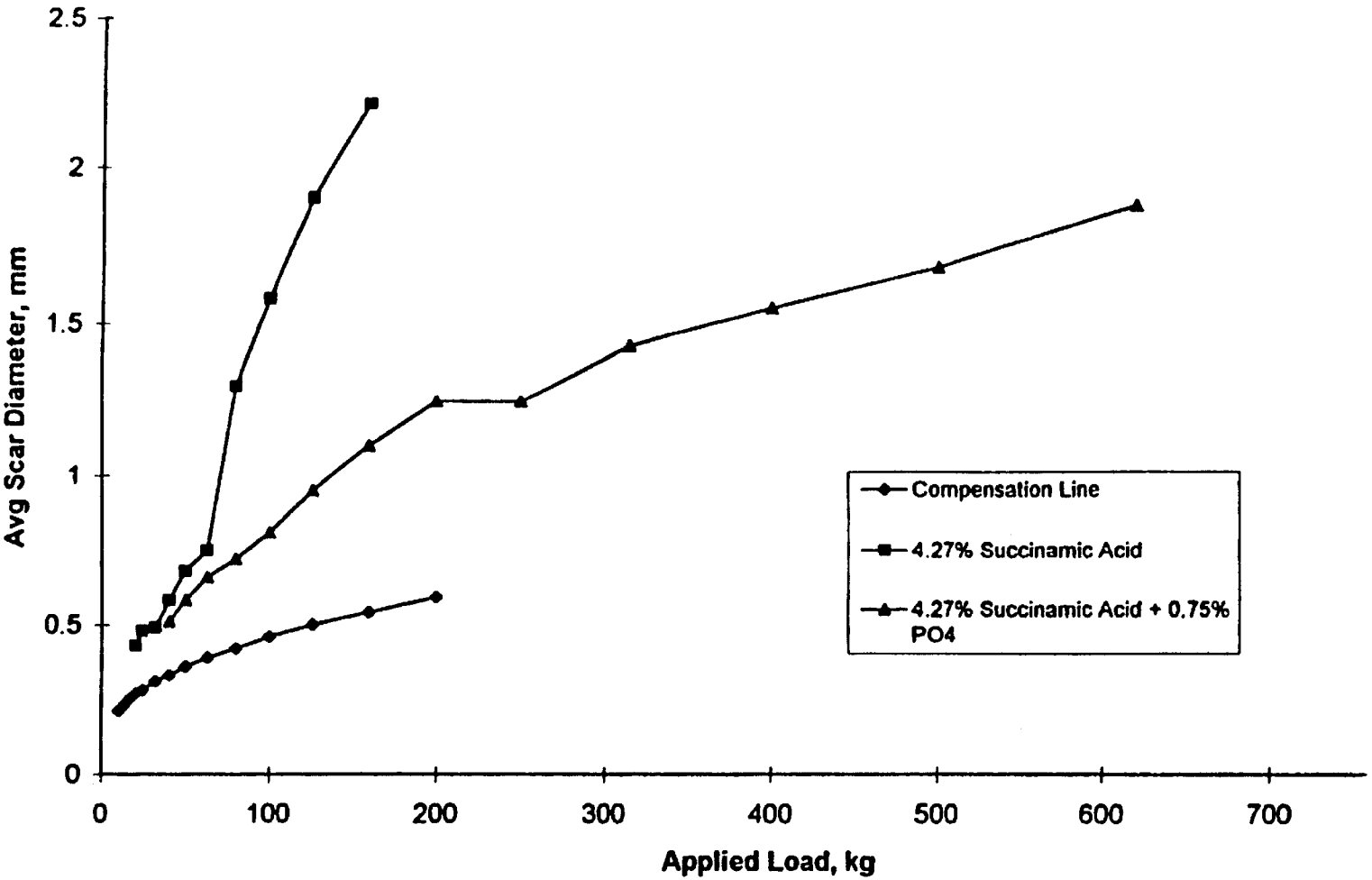
Figure 18:
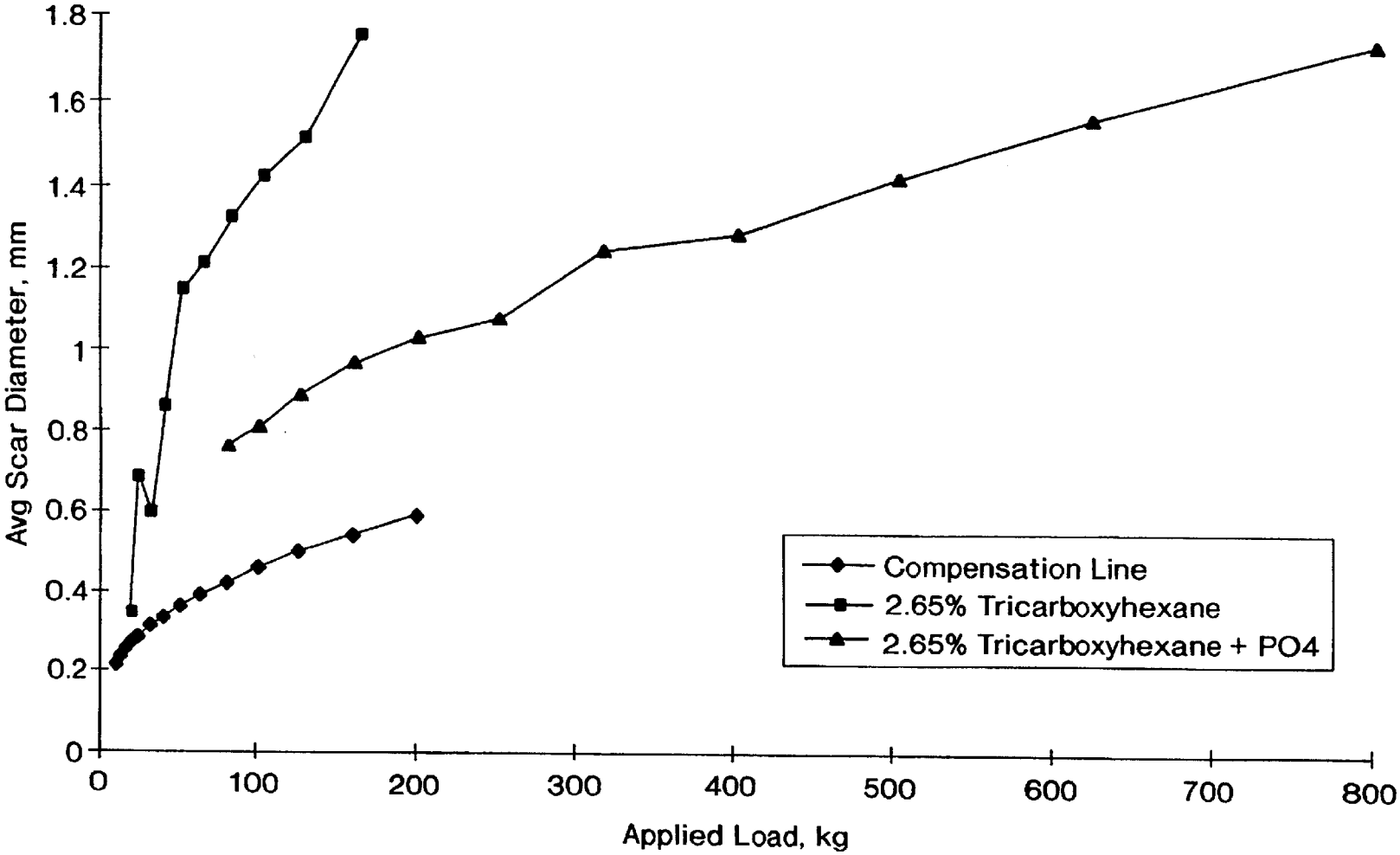

FIG. 15 shows the scar diameter vs. applied load for poly(2-ethyl-2-oxazoline) in the presence and absence of phosphate. FIG. 16 shows the scar diameter vs. applied load for malic acid in the presence and absence of phosphate. FIG. 17 shows the scar diameter vs. applied load for tricarboxyhexane in the presence and absence of phosphate. FIG. 18 shows the scar diameter vs. applied load for succinamic acid in the presence and absence of phosphate.

Example 3

Figure 13:
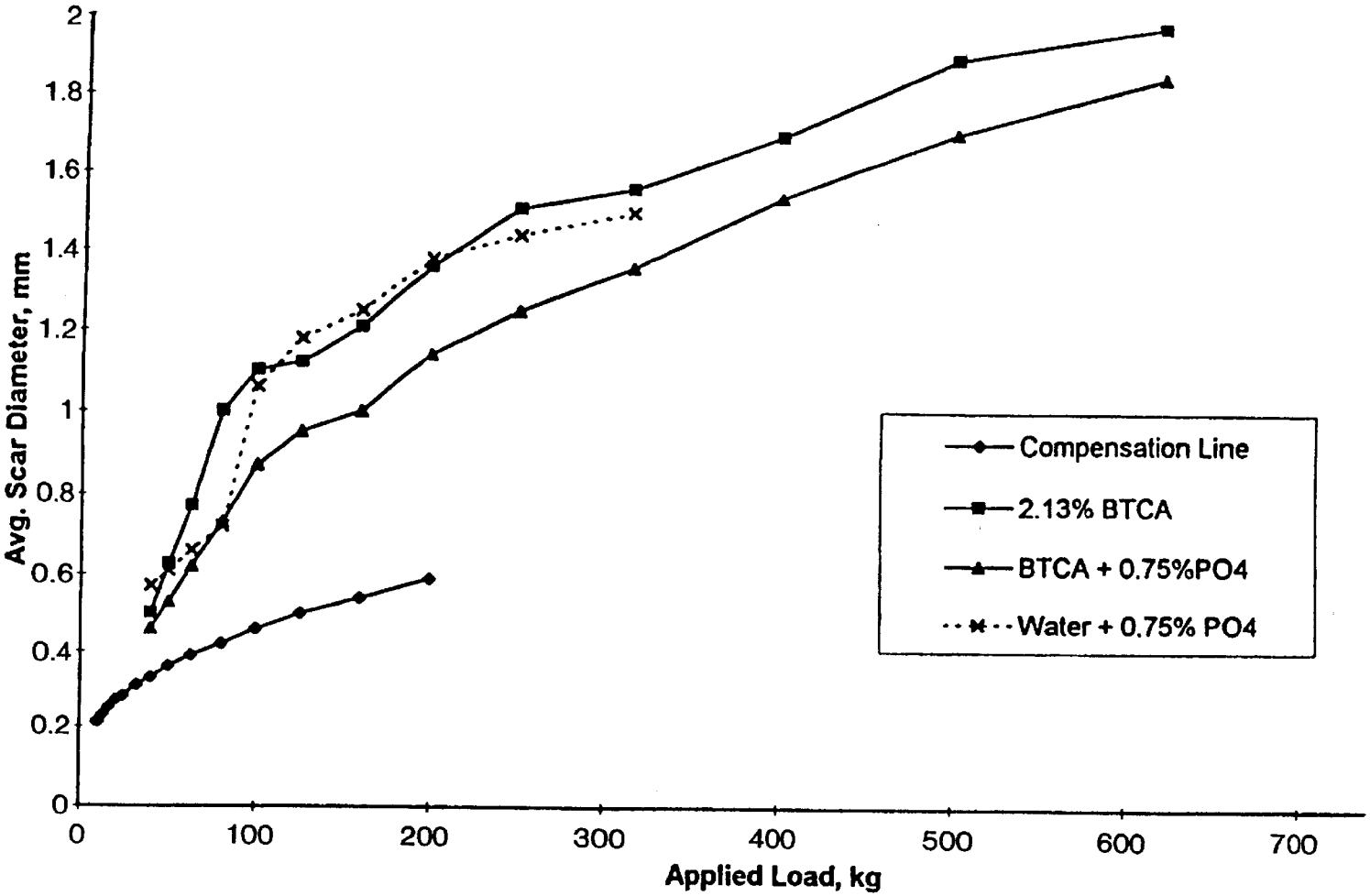

The test solutions where prepared by dissolving the 1, 2, 3, 4-butanetetracarboxylic acid in water and adjusting the pH to 10. The solutions were tested using a Four-ball Extreme Pressure machine. The scar diameter and the applied load at which welding occurred were measured. FIG. 13 below shows the results of the Four-ball extreme pressure test. The high pressure shows the independent lubricating properties of this molecule which can be employed with or without a component of Group B.

Example 4

Bovine somatotropin (bST) is an animal protein which can be employed in this invention as a component of Group A, for example. bST solution was tested by the ASTM D4172 "Wear Preventative Characteristic of Lubricating Fluids (Four-ball test) with both aluminum and steel balls. There was no noise during the tests for all three bST concentrations shown in Table II below. The scar diameter and friction coefficients indicate that the fluid has lubricant capability.

TABLE II

| | 4-ball on Aluminum Scar dia. mm | 4-ball on Steel Scar dia. mm | Timken friction coef. Steel 2 lb |
|---|---|---|---|
| bST 1.0% | 0.81 | 0.56 | 0.16 |
| bST 1.0% | 0.72 | 0.55 | Not Measured |
| bST 2.0% | 0.50 | 0.55 | 0.17 |

FIG. 14 below shows using ASTM method D2783 it was shown that a mixture of bST with phosphate afforded a synergistic extreme pressure lubricating effect affording a weldload at of 200 kg as bST alone and a weldload of 620 when bST and phosphates were together.

Example 5

A solution of 7.5% bovine serum albumin (BSA) and 5.0% phosphate ($PO_4^{-3}$) in water at pH 8.60, was diluted 9:1 with water, and run in the Timken tester using a steel ring and a carbon steel block, obtaining a friction coefficient of 0.20. (conditions: 2 lb normal force applied). The source of the bovine serium albumin employed was fraction V material, isolated by the heat-shock method (material obtained from Sigma Chemical Company).

Solutions of BSA in water were tested in the 4-Ball tester, using three fixed aluminum balls and one rotating steel ball. A 7.5% solution of BSA afforded a 0.7 mm scar diameter, making no noise during the test. A 0.75% solution of BSA afforded a 0.6 mm (mm=millimeter) scar diameter, also making no noise during the test. Using ASTM method D2783 it was shown that a mixture of BSA with phosphate afforded a synergistic extreme pressure lubricating effect affording a weld load of 250 kg without phosphate and a weld load and 620 kg when phosphate was added.

Example 6

A solution of 1% dodecylamino —N,N-bismethylenephosphonic acid in water, adjusted to a pH of about 6 was examined using the test method described in ASTM D4172, "Wear Preventative Characteristic of Lubricating Fluids (Four-Ball test)", incorporated herein by reference, with both aluminum and steel balls. The scar diameter on steel was 0.45 mm and on aluminum was 0.55 mm to both cases (see Table III below), there was no noise (sound from the test itself) during the test. These results indicate that the fluid has lubricant capability. This is an example of a component of Group A being employed exclusively, that is without a component from Group B in practicing this invention.

Example 7

A solution of 1 wt % octylsulfonylbutyric acid in water, adjusted to a pH of about 9 was examined using the test method described in ASTM D4172, "Wear Preventative Characteristic of Lubricating Fluids (Four-Ball test)", incorporated herein by reference, with 6061 aluminum balls. The scar diameter on aluminum was 0.49 mm (see Table III below), there was no noise during the test. This solution was further examined using a method involving drilling 20 ¼" holes into a 356 aluminum block. No noise was produced in the drilling process and no oversized hole was found. These results indicate that the fluid has lubricant capability. This is an example of a component of Group A being employed exclusively, that is without a component from Group B in practicing this invention.

TABLE III

Examples of Group A Being Employed Exclusively

| No. | Compound Name | Compound Formula | AL 4-ball 1% scar dia. | AL 4-ball 1% noise | Al Drill no. of holes without noise |
|---|---|---|---|---|---|
| 1 | octylthiobutyric acid | $C_8$—S—$C_3CO_2H$ | 0.48 | No | 20 |
| 2 | octylthiopropanoic acid | $C_8$—S—$C_2CO_2H$ | 0.6 | No | NT |
| 3 | octylsulfonylbutyric acid | $C_8$—$SO_2$—$C_3CO_2H$ | 0.49 | No | 19–20 |
| 4 | (octyl/decyl)oxy-propanoic acid | ($C_8$/$C_{10}$)—O—$C_2CO_2H$ | 0.4 | No | 20 |
| 5 | dodecyloxy-propionic acid | $C_{12}$—O—$C_2CO_2H$ | 0.4 | No | 20 |
| 6 | monooctyl succinate | $C_8$—OC(O)$C_2CO_2H$ | 0.53 | No | NT |
| 7 | N-octylsulfonyl Beta-alanine | $C_8$—$SO_2NHC_2CO_2H$ | 0.98 | Slight | NT |
| 8 | nonylaminosulfonylpropanoic acid | $C_9$—$NHSO_2C_2CO_2H$ | 0.5 | No | NT |
| 9 | nonylamidoadipic acid | $C_9$—$NHCOC_4COOH$ | 0.45 | No | 18–20 |
| 10 | N-cocoyl glycine | $C_{11}$(blend)—$CONHCH_2CO_2H$ | 0.45 | No | NT |
| 11 | dodecyltriethoxy sulfate | $C_{12}O(EtO)_3$-$OSO_2OH$ | 0.72 | No | NT |
| 12 | dodecyltetraethoxy sulfate | $C_{12}O(EtO)_4$-$OSO_2OH$ | 0.74 | No | NT |
| 13 | dodecyaminobismethylenephosphonic acid | $C_{12}$—$N(CH_2PO(OH)_2)_2$ | 0.55 | No | 20 |
| 14 | octylaminobismethylenephophonic acid | $C_8$—$N(CH_2PO(OH)_2)_2$ | 0.78 | No | NT |
| 15 | 4-methylthio-2-hydroxybutyric acid | $MeSC_3CH(OH)CO_2H$ | 0.8 | No | NT |
| 16 | dodecyphenylsulfonic acid | $C_{12}$—Ar—$SO_3H$ | 0.53 | No | NT |
| Comparative Examples: | | | | | |
| 1 | N-lauroylsarcosine acid | $C_{11}$—$CON(CH_3)CH_2CO_2H$ | 0.48 | No | NT |
| 2 | N-oleoylsarcosine acid | $C_8C{=}CC_7CO$—$N(CH_3)CH_2CO_2H$ | 0.5 | No | NT |
| 3 | dodecylsuccinic acid | $C_{12}$—$CH(CO_2H)CH_2CO_2H$ | 0.72 | No | NT |
| 4 | ricinoleic acid | $C_6$—CH(OH)—$CH_2CH{=}CH$—$C7CO_2H$ | 0.45 | No | NT |
| 5 | lauric acid | $C_{11}CO_2H$ | 0.43 | No | 20+ |

TABLE III-continued

Examples of Group A Being Employed Exclusively

| No. | Compound Name | Compound Formula | AL 4-ball 1% scar dia. | AL 4-ball 1% noise | Al Drill no. of holes without noise |
|---|---|---|---|---|---|
| 6 | tridecanoic acid | $C_{12}CO_2H$ | 0.45 | No | NT |
| 7 | dodecylphosphoric acid | $C_{12}$—O—$PO(OH)_2$ | 0.45 | No | NT |

NT = Not Tested

Without being limited, this invention encompasses a variety of compositions, uses and effective use options depending on the composition and use envisioned as is apparent from reading this specification and is not limited to any specific operation, composition or use but for example includes those operations such as whereby a composition is applied to, applied by, brought in contact with or effectively provided to by any effective application means including illustratively such as those known to those of skill in the art including for example deluge, pump,misting, spraying and the like to a metal or to a tool depending, of course, on use and composition. All parts and percentages employed herein are by weight unless otherwise specifically recited.

Although the invention has been described above in terms of some specific embodiments which are set forth in considerable detail, it should be understood that this description is by way of illustration only and that the invention is not necessarily limited thereto, since alternative embodiments and operating techniques will become apparent to those skilled in the art in view of this disclosure. Accordingly, modifications are contemplated which can be made without departing from the spirit of the aforedescribed invention.

What is claimed is:

1. An aqueous composition for metal working, comprising water and a lubricating functionally effective amount of a fluid lubricant composition comprising:

(a) one or more water soluble components selected from a first group (A) comprising:

carboxylic acids and salts thereof wherein said carboxylic acids are mono- or polycarboxylic acids, with the provisos (1) that when said monocarboxylic acids have one to six carbon atoms optionally functionalized with a functional group selected from $C_1$–$C_{20}$ alkoxy, sulfone, alkylene phosphonates, sulfide or functionalized amines and salts or esters thereof, that said monocarboxylic acid does not include 2-hydroxybutyric acid and 3-hydroxybutyric acid; and (2) that when said carboxylic acid is represented by the formula:

$$R_1CO_2H \quad (I)$$

where in connection with formula (I), $R_1$ is hydrogen, $C_{1-6}$ alkyl, or $R_1$ is $R_aOR_b$—, where $R_a$ is $C_{6-20}$ linear or branched alkyl, and $R_b$ is $C_{1-6}$ linear or branched alkylene, or $R_1$ is $R_cSR_d$—, where $R_c$ is $C_{1-20}$ alkyl, and $R_d$ is $C_{1-6}$ alkylene or hydroxyalkylene, that $R_1$ cannot be 3-carboxypropyl or 2-carboxymethyl substituted alkyl; and mercaptocarboxylic acids and salts thereof; and (b) one or more water soluble components selected from a second group (B) comprising phosphates, borates, phosphonates, phosphites and hypophosphites; with the provisos that when said group (A) component is an aliphatic di- or tri-carboxylic acid, said group (B) component is not a borate, when said group (A) component is a dicarboxylic acid, said group (B) component is not a phosphate salt, when said group (A) component is polyaspartic acid or salts thereof, said group (B) component is not a phosphate or borate, and when the group (A) component is caprylic acid, the group (B) component is not a phosphate or borate.

2. The composition of claim 1 wherein said composition further comprises a reaction product(s) of said composition formed from a component or components therein or the application of said composition to a metal being worked or tool working the metal or both.

3. The composition of claim 1 wherein said fluid lubricant composition has a lubricant property selected from the group consisting of extreme pressure, boundary lubricant, simple film or anti-wear or a combination thereof.

4. The composition of claim 1 or 3 wherein said fluid lubricant composition is an extreme pressure lubricant and said component of group (A) is a monocarboxylic acid having onr to six carbon atoms optionally functionalized with a functional group selected from $C_1$–$C_{20}$ alkoxy, sulfone, alkylene phosphonates, sulfide or functionalized amines and salts thereof.

5. The composition of claims 1 or 3 wherein said fluid lubricant composition is a boundary lubricant and said component of group (A) has a chemical structure $R_1COOH$ wherein $R_1$ is $R_aOR_b$ or $R_cSR_d$, where $R_a$ is $C_{6-20}$ linear or branched alkyl, $R_b$ is $C_{1-6}$ linear or branched alkylene, $R_c$ is $C_{1-20}$ alkyl and $R_d$ is $C_{1-6}$ alkylene or hydroxyalkylene.

6. The composition of claim 1 wherein said polycarboxylic acid comprises a polymer with repeating units which contain carboxylate groups.

7. The composition of claim 1 wherein said component of group (A) is a carboxylic acid as its acid or salt, represented by the formulas:

$$R_1CO_2H \quad (I)$$

and $$R_2[(CH_x)_mCHCO_2H]_n(CH_y)_oR_3 \quad (II)$$

wherein connection with formula (II), $R_2$ and $R_3$ are the same or different independently and may be independently hydrogen or oxygen or an organic group including alkyl, and/or aryl, mercapto, thio or dithiorganic moieties, hydroxy, hydroxyalkyl, alkenyl, or alkoxy, alkoxyalhyl, or aromatic when employed in this formula (II), x and y are numerically either 1 or 2, m is 0 to about 40, o is 0 to about 18, and n is 1 to about 5000 or 7000 or more and m, n, and o are independent integers with the proviso that $R_1$, cannot be 3-carboxypropyl or 2-carboxymethyl substituted alkyl.

8. The composition of claim 7 wherein said carboxylic acid is selected from the group consisting of N-phosphonomethylglycine and water soluble salts; lactic acid, formic acid, glycolic acid, glyceric acid, octlthiobutyric acid, octylthiopropanoic acid, decyloxypropanoic acid, dodecyloxypropanoic acid, 4-methylthio-2-hydroxybutyric acid, and salts thereof and mixtures thereof.

9. The composition of claim 8 wherein said carboxylic acid is selected from the group consisting of N-phosphonomethylglycine and its water soluble salts, formic acid and its salts, lactic acid and its salts and mixtures thereof.

10. The composition of claim 1 wherein said carboxylic acid is a polycarboxylic acid selected from the group consisting of polyacrylic acid, butanetetracarboxylic acid selected from the group consisting of polyacrylic acid, butanetetracarboxylic acid, oxalic acid, malonic acid, succinic acid, glutaric acid, adipic acid, pimelic acid, suberic acid, azelaic acid, dodecanedioic acid, undecanedioic acid, propanetricarboxylic acid, tartic acid, sebacic acid, maleic acid, fumaric acid, citric acid, itaconic acid, citraconic acid, malic acid, aconitric acid and brassylic acid and tricarboxyhexane(s) and salts thereof.

11. The composition of claim 10, wherein said polycarboxylic acid is selected from the group consisting of polyacrylic acid, butanetetracarboxylic acid, oxalic acid, succininc acid, tartaric acid, citric acid and tricarboxyhexane(s) and salts thereof.

12. An aqueous composition for metal working, comprising water and a lubricating functionally effective amount of a fluid lubricant composition comprising 1,2,3,4-butanetetracarboxylic acid or a salt thereof.

13. The composition of claim 1, wherein the component of group (A) is a mercaptocarboxylic acid represented by the formula:

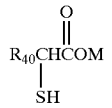

(XV)

wherein $R_{40}$ is selected from alkyl $C_{1-30}$ or carboxyalkyl $C_{1-30}$, and M is selected from hydrogen, alkali metal, ammonium or mixtures thereof.

14. The composition of claim 1 wherein said component of group (A) is selected from nitrilotriacetic acid or a salt thereof, succinamic acid or a salt thereof, 4-hydroxybutyric acid or a salt thereof, dithiopropionic acid or a salt thereof, dihydroxyacetone dimer, polyethyleneimineethoxylated, polyglyoxylate or a salt thereof, monoammonium maleate or diammonium maleate.

15. The composition of claim 1, wherein two components are employed from group (A) which comprise polyaspartic acid or salts thereof and polyacrylate.

16. The composition of claim 15, wherein two components are employed from group (A) which comprise potassium polyaspartic acid and polyacrylate.

17. The composition of claim 1 wherein said component from group (A) is a carboxylic acid or polycarboxylic acid selected from 4-hydroxybutyric acid, oxamic acid, polyglyoxylate, 1,3,6-tricarboxyhexane, succinamic, lactic, tartaric, citric acid, malic acid, oxalic acid, maleic acid, 1,2,3,4-butanetetracarboxylic acid, N-phosphonomethylglycine, polyacrylic acid, or formic acid or salts thereof.

18. The composition of claim 1 wherein said component employed from group (B) is a borate.

19. The composition of claim 1 wherein said component of group (B) is a phosphate or a phosphonate.

20. The composition of claim 19 wherein said phosphate is an orthophosphate.

21. The composition of claim 20 wherein said orthophosphate is selected from the group consisting of the monobasic, dibasic or tribasic salt and fixtures thereof having a cation selected from an alkali metal, ammonium and alkylammonium.

22. The composition of claim 19 wherein said phosphate, as its salt, is selected from the group consisting of pyrophosphoric acid, metaphosphoric acid, hypophosphoric acid, phosphorous acid, polyphosphoric acid and mixtures thereof.

23. The composition of claim 1 wherein the component of group (B) is selected from 1-hydroxyethylidene-1,1-diphosphonic acid, aminotri(methylenephosphonic acid), dodecylaminobismethylenephosphonic acid, hexamethylenediaminetetra(methylenephosphonic) acid, diethylenetriaminepenta(methylenephosphonic) acid, N-phosphonomethylglycine, 2-phosphono-1,2,4-butanetricarboxylic acid, hydroxyphosphonoacetic acid, salts thereof or mixtures thereof.

24. The composition of claim 1 wherein said component of group (A) is polyaspartic acid or a salt thereof and a component of group (B) is 1-hydroxyethylidene-1-diphosphonic acid or a salt thereof.

25. The composition of claim 18 wherein a component is employed from group (B) and is selected from $K_2B_{10\ O16}$, boric acid or a salt thereof.

26. A method for metal working, wherein said method comprises providing as a lubricant to said metal, a lubricating effective amount of a fluid lubricant composition of claim 1.

27. The method of metal working of claim 26, wherein said metal working comprises all metal working operations including metal forming and/or grinding and/or metal removal.

28. A method of metal working of claim 27 wherein said metal working is forming.

29. A method of metal working of claim 27 wherein said metal working is grinding.

30. The method of metal working of claim 26, wherein said method comprises feeding a metal working water-soluble lubricant composition to a metal useful to receive the same, comprising optionally diluting said metal working water soluble lubricant composition and feeding the optionally diluted or non-diluted water soluble composition to a portion of the metal by applying (spraying or dripping) whereby said composition is effectively provided to said metal.

31. The method of claim 26 wherein said fluid lubricant composition is selected from the composition of claims 4–6, 7–12, 13, 14, 15, 16, 17, 18–23, 24, and 25.

32. The composition of claim 1 further comprising one or more corrosion inhibitor(s).

33. The composition of claim 32, in which the corrosion inhibitors are longer chain and substituted mono-, di- and tri-amines selected from 2,2'-ethylenedioxy-bis (ethylamine), trioctylamine, tris(2-aminoethyl)amine, polyethyleneimine, N,N,N',N'-tetrakis(2hydroxyethyl) ethylene diamine, 4(aminomethyl)-1, 8-octane diamine, iminobispropylamine or bishexamethylene-triamine.

34. The composition of claim 32 in which the corrosion inhibitors are lysine or ornithine.

35. The composition of claim 32 in which the corrosion inhibitor is DIPSO (3-[N,N-bis(2-hydroxyethyl(amino]-2-hydroxy-propanesulfonic acid.

36. The composition of claim 32 in which corrosion inhibitors are imidazoles selected from 1-methylimidazole, 1-(3-aminopropyl)imidazole, or 1,2dimethylimidazole.

37. The composition of claim 32 in which the corrosion inhibitor is triethanolamine.

38. A method of reducing tool wear during the metal working of titanium or alloys thereof wherein said metal working comprises metal working operations comprising a tool, using a metal working composition of claim 1 wherein the component of group (A) is a polycarboxylic acid or a salt thereof.

39. The method of claim 38 wherein said polycarboxylic acid is selected from polyacrylic acid, butanetetracarboxylic acid, oxalic acid, malonic acid, succinic acid, glutaric acid, adipic acid, pimelic acid, suberic acid, azelaic acid, dodecanedioic acid, undecanedioic acid, propanetricarboxylic acid, tartaric acid, sebacic acid, maleic acid, fumaric acid, citric acid, itanconic acid, citraconic acid, malic acid, aconitic acid and brassylic acid, tricarboxyhexane(s) or salts thereof.

40. The method of claim 39 wherein said polycarboxylic acid is selected from 1,2,3,4-butanetetracarboxylic acid, succinic acid or a salt thereof.

41. The composition of claim 1 wherein the amount of a component selected from group (A) is in the range from about 0.1% to about 75% by weight of the total composition.

42. The composition of claim 41 wherein the concentration of the component of group (A) is in the range from about 0.25% to about 25% by weight for the total composition.

43. The composition of claim 1 wherein a component is utilized from group (A) and a component from group (B), the amount of a component selected from group (B) is in the range from about 0.1 to about 60% by weight.

44. The composition of claim 43 wherein the concentration of the component of group (B) is in the range from about 0.25 to about 15% by weight for the total composition.

45. The fluid composition of claim 1 wherein more than one component is utilized from group (A) and/or from group (B).

46. The fluid composition of claim 19 wherein a phosphonate is employed as the component from group (B) and the concentration of the phosphonate is in the range from about 0.075% to about 50%.

47. The composition of claim 46 wherein the concentrated of the phosphonate is in the range from about 0.10% to about 15% by weight.

48. The composition of claim 47 wherein the concentration of the phosphonate is in the range from about 0.10% to about 10% by weight.

49. The composition of claim 1 wherein the component of group (A) is a salt or mixtures thereof, or the component of group (B) is a salt or mixtures thereof, or both components of group (A) and group (B) is a salt or a mixture thereof or neither component of group (A) or group (B) is a salt.

* * * * *